US006895949B1

(12) United States Patent
Stephens

(10) Patent No.: US 6,895,949 B1
(45) Date of Patent: May 24, 2005

(54) PITCH DYNAMICS DEVICE FOR CONTROLLING THE PITCH DYNAMICS OF FAST-SPEED AND OFF-SPEED PITCHES THROWN FROM A SINGLE-WHEEL PITCHING MACHINE

(76) Inventor: Stacy W. Stephens, 377 Saddle Club Rd., Trenton, GA (US) 30752

( * ) Notice: Subject to any disclaimer, the term of this patent is extended or adjusted under 35 U.S.C. 154(b) by 0 days.

(21) Appl. No.: 10/671,175

(22) Filed: Sep. 24, 2003

(51) Int. Cl.[7] ..... F41B 4/00
(52) U.S. Cl. ..... 124/6
(58) Field of Search ..... 124/6, 78, 32, 124/34

(56) References Cited

U.S. PATENT DOCUMENTS 1,211,738 A * 1/1917 Marty ..... 124/6
5,012,790 A * 5/1991 Bates ..... 124/81
5,826,568 A * 10/1998 Van Ross, Jr. ..... 124/6
6,089,217 A 7/2000 Paulson et al.
6,305,366 B1 10/2001 Rizzo et al.
6,402,640 B1 6/2002 Stuart
6,415,782 B1 7/2002 Holland

* cited by examiner

*Primary Examiner*—John A. Ricci

(57) ABSTRACT

The present invention relates to a pitch dynamics device, the pitch dynamics device being interconnected with a pitching machine for causing the pitching machine to vary the pitch dynamics of pitched balls. Optimally, variances in pitch dynamics can include varying pitch speed, pinch plate angle, and the pitch release point. The pitch dynamics device can vary the pitch dynamics of pitched balls by adjusting a pinch plate position and angle to control the location of a pitch release point, trajectory angle, and ball release speed. The resultant is that the pitch dynamics device can allow a single-wheel pitching machine to throw different speed pitches with similar accuracy, in a batter's strike zone area, without changing the pitching machine setup which may include recalibrating the pitching machine, throwing a series of test pitches to verify pitch accuracy, changing pitching machine wheel speed, or adjust pitching machine tilt angle.

19 Claims, 18 Drawing Sheets

500

1000

2000

3000

3000

4000

5000

PITCH DYNAMICS DEVICE FOR CONTROLLING THE PITCH DYNAMICS OF FAST-SPEED AND OFF-SPEED PITCHES THROWN FROM A SINGLE-WHEEL PITCHING MACHINE

TECHNICAL FIELD OF THE INVENTION

A pitching machine having a pitch dynamics device attached thereto for controlling the pitch dynamics of pitched balls. Optimally, controlling the pitch dynamics can include varying pitch speed and the pitch release point. The pitch release point is the spot where the pitched ball looses contact with the pitching machine. The pitch release point can also be referred to as the pitch point. Such control of pitch dynamics can result in the throwing of different speed pitches and pitch trajectories with similar pitch location accuracy from a single-wheel pitching machine.

The pitch dynamics device can vary the pitch dynamics of pitched balls by adjusting a pinch plate angle to control the location of a pitch release point, trajectory angle, and ball release speed. The resultant is that the pitch dynamics device can allow a single-wheel pitching machine to throw different speed pitches with similar accuracy in a batters strike zone area without changing the pitching machine setup which may include recalibrating the pitching machine, throwing a series of test pitches to verify pitch accuracy, changing pitching machine wheel speed, or adjust pitching machine tilt angle.

BACKGROUND OF THE INVENTION

The standard single-wheel pitching machine utilizes a wheel and a stationary pinch plate to guide the pitched balls uniformly to a pitch release point. The circumference of the ball being pitched typically determines the spacing between the pitching wheel and the pinch plate. Fixed common settings can typically accommodate 12-inch circumference softball, 11-inch circumference softball, and 9-inch circumference baseball.

A ball entry chute is provided to guide the ball to the pitching machine pitching wheel. The pitching wheel accelerates the ball and pinches the ball between the pitching wheel and the pinch plate. The ball travels along the pinch plate to the pitch release point, a point where the ball looses contact with the pitching machine. Typically, a variable speed motor is utilized to drive the pitching wheel. A control is typically provided to vary the speed of the wheel and thus the speed of the pitched ball. The ball is shot out, of the pitching machine, to the batter with certain pitch dynamics. Such pitch dynamics can include a specific height, pitch speed, and pitch trajectory angle. The dynamics of the pitch are typically controlled by the pitching wheel speed, and the angle or tilt of the pitching machine.

A problem with the standard pitching machine is that the pinch plate is fixed and to vary the pinch plate typically requires stopping the pitching machine to make adjustments, and then restarting the machine. In addition, typically some dismantling and reassembly of pitching machine parts is required to make adjustment to the pinch plate. Furthermore, the pinch plate is typically only adjusted to accommodate different size balls, such as the 12-inch circumference softball, 11-inch circumference softballs, and 9-inch circumference baseball and once adjusted remains fixed.

Such adjustments to the pinch plate take longer than a batter is accustom to waiting, as compared to the time in-between pitches or time in-between batters, and can require a series of test pitches to fine tune the pitch trajectory and accuracy after adjustment. As such, such modifications to the pitching machine cannot be performed to provide variation in pitch dynamics to simulate the conditions batters typically face in game situations.

Another problem with the standard pitching machine is that with the fixed settings the pitch dynamics remain constant. As a result, every pitch is virtually identical. In this regard, batters can become more conditioned to the constant and repetitious pitch dynamics then to learning how to hit different types and kinds of pitches.

In other words, the fixed wheel speed and fixed trajectory angle, tend to cause the pitched balls to arrive at the batter in a fairly uniform location and at a fairly uniform speed. Unless the operator changes the setup of the pitching machine the pitched balls remain fairly consistent (typically within 2 or 3 miles per hour (MPH)). As such, the challenge to the hitter can be diminished in that every pitch is virtually the same.

To change the pitch dynamics typically tilt of the pitching machine in combination with varying the pitching machine wheel speed is required. This process can require significant time, trial and error adjustments, and a series of test pitches to fine tune the pitch speed and pitch location with respect to the batter. Though alone varying the speed of the pitching wheel can change ball speed, simply changing the pitching wheel speed can result in a pitch that is too high, or falls short of the strike zone. As such, varying only the pitching wheel speed does not produce adequate results.

To vary types and kinds of pitches pitched to a batter typically two or more pitching machines are employed and setup side-by-side. Each pitching machine is typically setup to throw a different type or kind of pitch (i.e. fastball, changeup, curveball, etc.). Balls are then presented to one of the pitching machines pseudo random to vary the pitched balls presented to the batter. However, the setup of multiple pitching machines to vary pitch types is also a flawed approach in that the batter can see which pitching machine is pitching the ball and thus knows what type of pitch to anticipate. In addition, the cost of this approach in requiring multiple pitching machines can be prohibitive and problematic in and of itself.

There is a long felt need for a pitch dynamics device that can be used on a single-wheel pitching machine for adjusting the pitch dynamics of pitched balls, which in part gives rise to the following invention. In this regard, there is a need for a pitch dynamics device that can allow a pitching machine to throw different types and kinds of pitches with similar accuracy in a batter's strike zone area without changing the pitching machine setup, which may include recalibrating the pitching machine, throwing a series of test pitches to verify pitch accuracy, changing pitching machine wheel speed, or adjusting pitching machine tilt angle.

SUMMARY OF THE INVENTION

The present invention relates to a pitch dynamics device, the pitch dynamics device being interconnected with a pitching machine for causing the pitching machine to vary the pitch dynamics of pitched balls. Optimally, variances in pitch dynamics can include varying pitch speed, pinch plate angle, and the pitch release point. The pitch release point can also be referred to as the pitch point. Such variations in pitch dynamics can result in the throwing of different speed pitches and pitch trajectories with similar pitch location accuracy.

The pitch dynamics device can vary the pitch dynamics of pitched balls by adjusting a pinch plate angle to control the location of a pitch release point, trajectory angle, and ball release speed. The resultant is that the pitch dynamics device can allow a single-wheel pitching machine to throw different speed pitches with similar accuracy in a batter's strike zone area without changing the pitching machine setup which may include recalibrating the pitching machine, throwing a series of test pitches to verify pitch accuracy, changing pitching machine wheel speed, or adjust pitching machine tilt angle.

The present invention also relates to a pitch dynamics device having an electronic control system for effectuating the positioning of the pinch plate and pitch release point. The resultant is that the control system can operate pitch routines and other programmatic control to control the pitch dynamics of pitched balls.

The present invention also relates to a pitch dynamics device having an electronic control system for allowing a user or operator, locally at the pitching machine or remotely (wired or wirelessly) to operate, program, data communicate, or otherwise control the pitch dynamics device, and as such control the pitch dynamics of pitched balls.

The present invention also relates to methods of pitching different speed and types of pitches by effectuating at least one of the following: manually selecting pitch speeds and or types, electronic control system selection of pitch speeds and or types, pseudo random selection of pitch speeds and or types, and or random selection of pitch speeds and or types.

The present invention also relates to making a determination as to whether the batter hit the pitched ball by way of a hit pitch detector. Such hit pitch detection can include acoustical detection (listening for the 'crack' of the bat on the ball), optical detection, detectable ball implant devices, and or other similar or suitable detection methods.

The presentation invention also relates to data processing including monitoring, control, data logging, data communicating, performance reporting, and other data effectuated activities. Such data processing can include batter performance, types and kinds of pitched balls, and or other statistical results, data, and or information.

BRIEF DESCRIPTION OF FIGURES

The present invention is best understood from the following detailed description when read in connection with the accompanying drawings. Included in the drawings are the following Figures.

DETAILED DESCRIPTION OF THE INVENTION

Figure 1A:
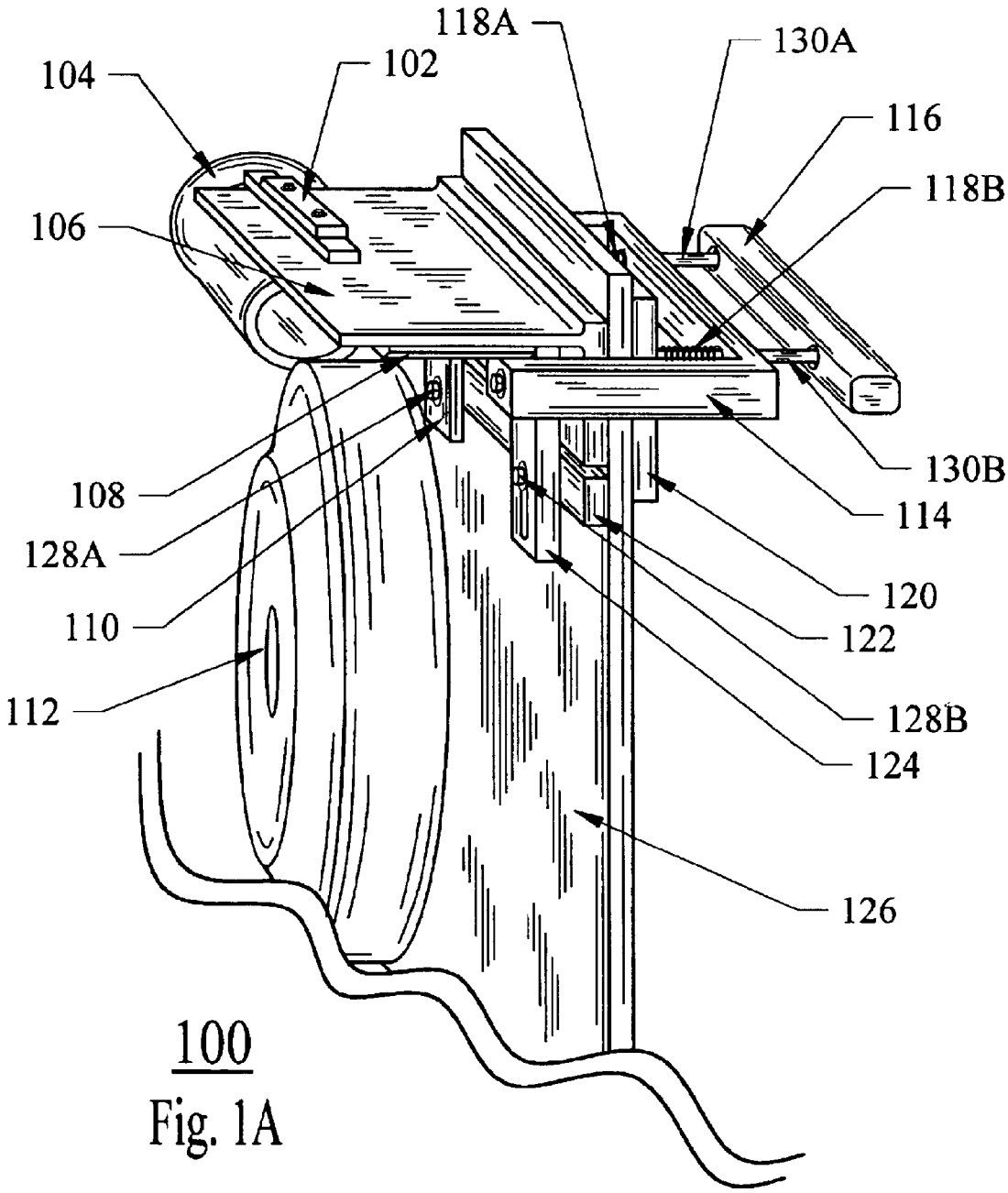
FIG. 1A shows a pitching machine 100 having a pitch dynamics device with handle embodiment attached thereto with the pitch dynamics device shown in the fast-speed pitch position.

Referring to FIG. 1A there is shown a pitching machine 100 having a pitch dynamics device with handle embodiment attached thereto. The pitch dynamics device shown is in the fast-speed pitch dynamics pitch position. In an exemplary embodiment a pitching machine 100 can have attached to it a pitch dynamics device. The pitch dynamics device allows a user or operator to position a pinch plate such as pinch plate 106 in at least two different positions. These positions can include a fast-speed pitch dynamics pitch position and an off-speed pitch dynamics pitch position that can result in the throwing of different speed pitches having different pitch trajectories. In addition, both the fast-speed pitch and off speed pitch arrive at the target position (batter's strike zone) with similar pitch location accuracy from a single-wheel pitching machine.

In this regard, a user can easily position the pinch plate to apply a varied amount of pressure to the pitched ball as well as control the pitch release point by way of controlling the angle and location of the pinch plate 106, such that the fast-speed pitch dynamics and off-speed pitch dynamics pitches can be thrown by the pitch machine 100 and arrive at the batter in the approximate same location, that location being preferably the batter's strike zone. Switching between fast-speed pitch dynamics and off-speed pitch dynamics pitches can be accomplished without requiring pitching machine setup changes which may include recalibrating the pitching machine, throwing a series of test pitches to verify pitch accuracy, changing pitching machine wheel speed, or adjust pitching machine tilt angle.

Shown in FIG. 1A is a pitching machine 100 having a pitch dynamics device attached thereto. Referring to FIG. 1A there is shown a pitching machine support bracket 126 and a pitching machine wheel 112. In an exemplary embodiment, the pitching machine support bracket 126 and pitching machine wheel 112 typically remain fixed and stationary in both the off-speed and fast-speed pitch positions of the pitch dynamics device and are part of the pitching machine.

The pitch dynamics device includes the pinch plate 106, pinch plate support legs 110 and 124, a pinch plate support 122, an alignment plate 128 also referred to as a locking plate 128, handle support 114, locking pins 130A and 130B, springs 118A and 118B, a handle 116, a ball entry chute 104, and a ball entry chute bracket 102. Handle support 114, pinch plate support legs 110 and 124, pinch plate support 122 can be referred to as a positioning actuator.

In an exemplary embodiment, a handle 116 can be used to move the pinch plate between an off-speed pitch dynamics position and a fast-speed pitch dynamics position. The handle 116 has springs 118A and 118B to position and hold the handle in the holes located in an alignment plate 120 (not viewable in FIG. 1A). The alignment plate 120 having alignment holes is better shown in FIG. 1F. Handle 116 can be referred to as a positioning actuator.

Figure 1B:
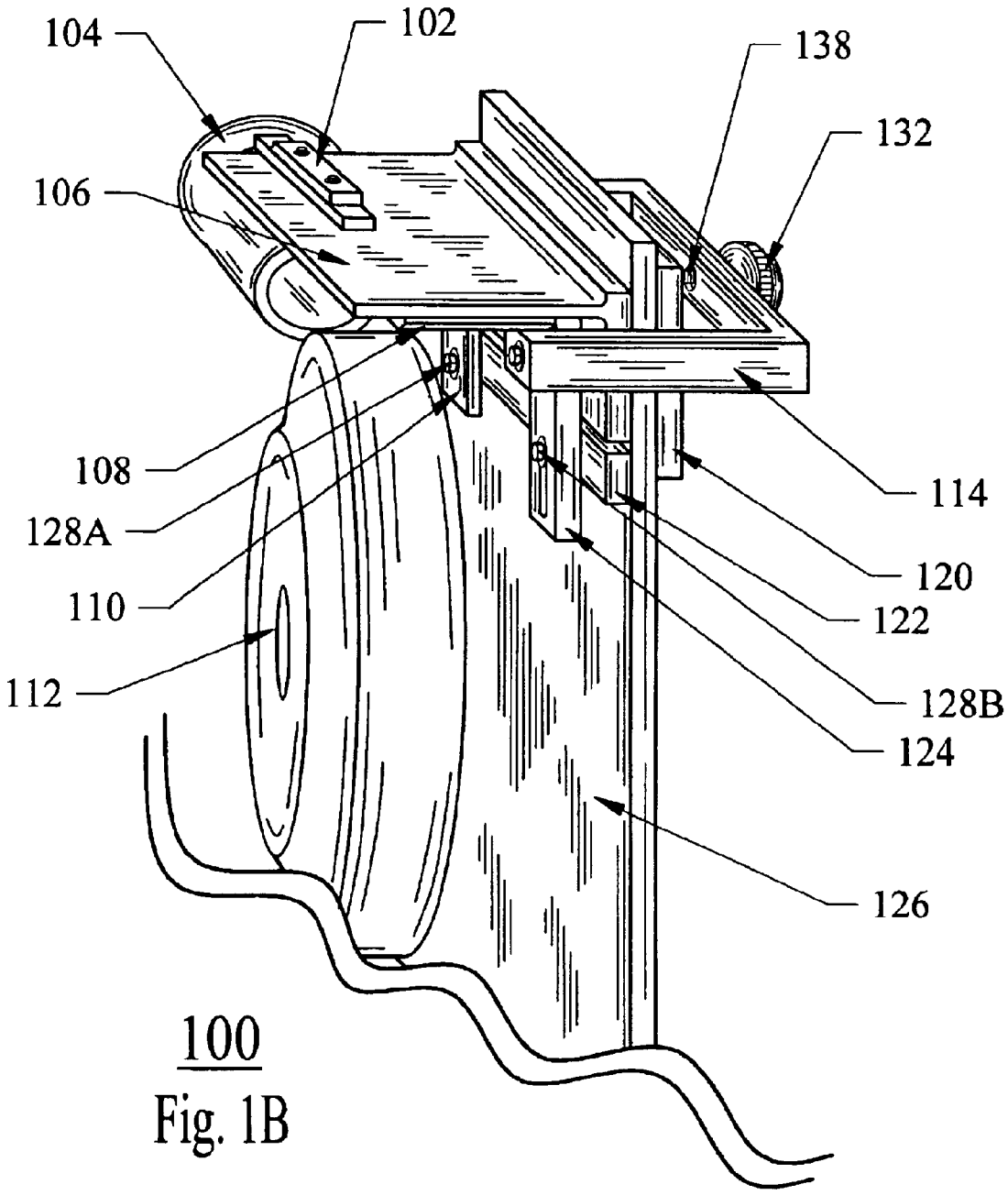
FIG. 1B shows a pitching machine 100 having a pitch dynamics device with knob embodiment attached thereto with the pitch dynamics device shown in the fast-speed pitch position.

In operation, a user can pull the handle 116 outwardly pulling the locking pegs 130A and 130B out of the alignment holes 134A and 134B (not shown in FIG. 1A) located in the alignment plate 120. The handle 116 can then be slightly rotated to position the locking pegs 130A and 130B in the appropriate alignment holes 134A or 134B. FIG. 1F shows the alignment holes 134A which position the pinch plate 106 in a mostly horizontal position resulting in the throwing of fast-speed pitch dynamics pitches. In addition, FIG. 1F shows alignment holes 134B which position the pinch plate 106 in an elevated position resulting in the throwing of off-speed pitch dynamics pitches. In another exemplary embodiment, the handle 116 can alternatively pivot around a center peg in lieu of locking pegs 130A and 130B.

Furthermore, the pulling of the handle 116 to slide-ably remove the locking pegs 130A and 130B from their positions in alignment plate 120 effectuates the ability to position the other elements of the pitch dynamics device as well. In this regard, the pinch plate 106, pinch plate support legs 110 and 124 along with the handle support 114 can be rotated, slid, and or otherwise aligned to position the pinch plate 106 in a fast-speed pitch dynamics pitch or an off-speed pitch dynamics pitch position.

The fast-speed pitch dynamics pitch position typically orientates the pinch plate 106 mostly horizontal with respect to the ball entering from ball chute 104 through to the pitch release point, the pitch release point is typically defined as the point at which the pitched ball looses contact with the pitching machine 100.

Figure 1C:
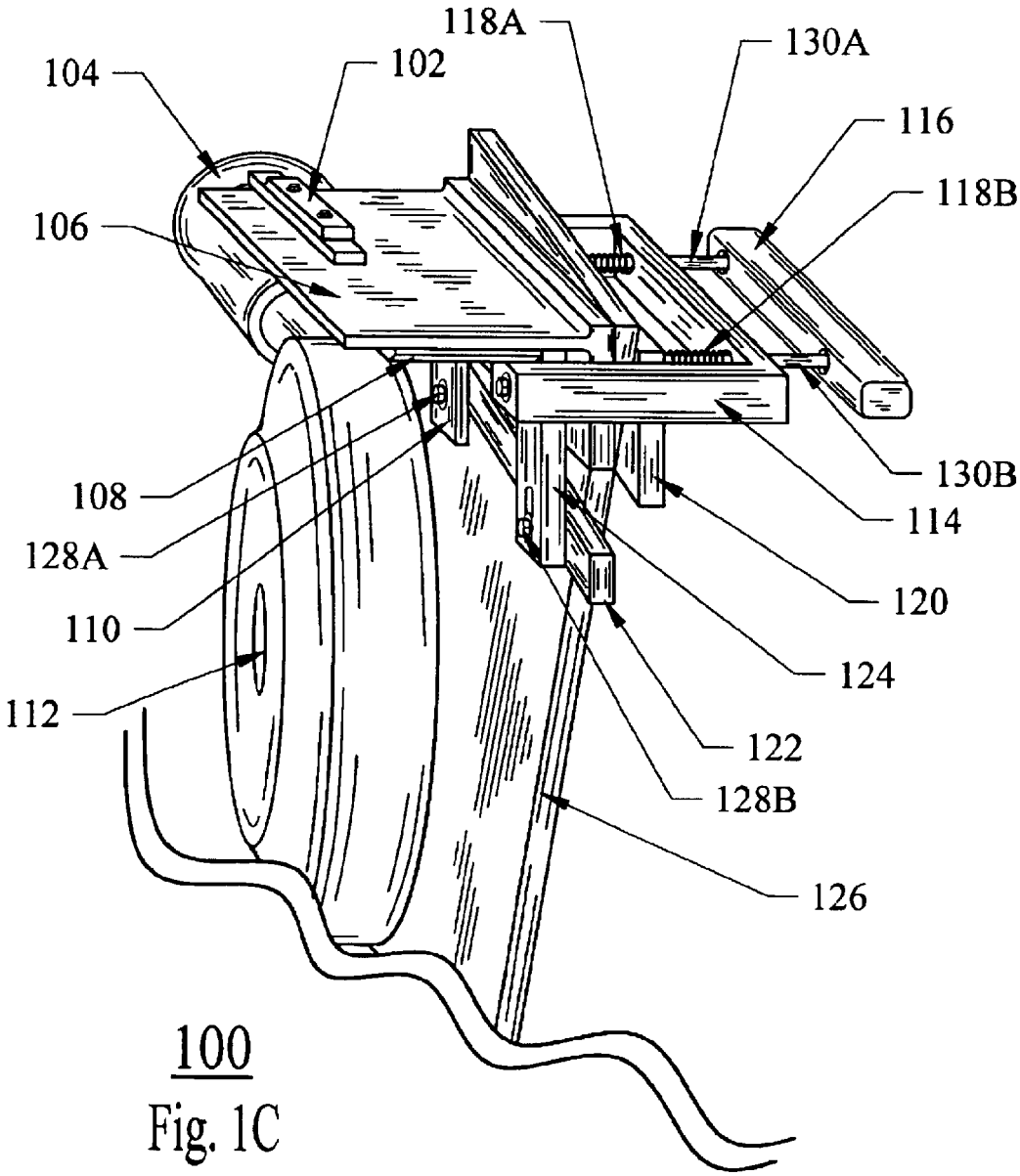
FIG. 1C shows a pitching machine 100 having a pitch dynamics device with handle embodiment attached thereto with the pitch dynamics device shown in the off-speed pitch position.

FIG. 1C better illustrates the pitch dynamics device in the off-speed pitch dynamics pitch position. The off-speed pitch position typically orientates the portion of the pinch plate 106 located closest to the ball chute 104 at a maximum distance from the pitching machine wheel 112. Furthermore, the off-speed pitch dynamics pitch position typically orientates the forward portion of the pinch plate 106, the portion closest to the handle support 114, at an elevated angle with respect to the rear of the pinch plate 106.

In this regard, a ball entering through ball chute 104 is pinched tighter between the pinch plate 106 and pitching wheel 112 in the fast-speed pitch dynamics pitch position verse the off-speed pitch dynamics position. The result is that the pitch is slowed while the pitch point is moved to the front edge of pinch plate 106 at an elevated angle, which causes the trajectory of the pitched ball to be elevated. As such, in this exemplary embodiment the pitch is slowed and the trajectory angle is increased such that the off-speed pitch dynamics pitch arrives at the batter within the batter strikes zone.

In other words, by moving the pitch dynamics device between the fast-speed pitch dynamics pitch position and the off-speed pitch dynamics pitch position different kinds of pitches, with different pitch dynamics, including different pitch speed and pitch trajectory angles, can be thrown by a single-wheel pitching machine 100 and arrive at a batter in relatively the same pitch location, that position being the batter's strike zone.

In moving the pitch dynamics device between fast-speed pitch dynamics pitch and off-speed pitch dynamics pitch positions slots 150 and 152 (shown and not labeled in FIG. 1A—see FIGS. 1G and 1H) cut into the pinch plate support legs 110 and 124, in part control the motion and positioning of the pinch plate 106. These slots 150 and 152 receive a bolt or other fastening means 128A and 128B. In this regard, motion of the pinch plate 106 is limited to the travel paths allowed by the length of the slots 150 and 152 cut into the pinch support legs 110 and 124. FIGS. 1G and 1H better show the interrelationship between the pinch plate 106, pinch plate support legs 110 and 124, the bolts or other fastening means 128A and 128B, and the slots 150 and 152 cut into the pinch plate support legs 110 and 124 respectively.

In an exemplary embodiment, slots 150 and 152 accurately position the pinch plate 106 in the fast-speed pitch dynamics and or off-speed pitch dynamics pitch positions. The length of the slots 150 and 152 cut into support legs 110 and 124 typically very depending upon the brand and mounting characteristics of the particular pitching machine 100.

In an exemplary embodiment, the slot 152 cut into pinch plate support leg 110 is shorter than the slot 150 cut into support leg 124. This allows the positioning controlled by pinch plate support leg 110 to locate the ball entry side of the pinch plate 106 and control the amount of pinch the ball undergoes during the pitching machine 100 pitching motion. As such, it is support leg 110 and the slot 152 cut into support leg 110 that allows the travel of the pinch plate 106, to more so than support leg 124, control the speed of the pitch.

With respect to pinch plate support leg 124 and the slot 150 cut into pinch plate support leg 124, support leg 124 mostly controls the pitch trajectory angle. As such, the length of the slot 150 is determined such that in the fast-speed pitch dynamics position the pinch plate 106 is orientated in a mostly horizontal position such that the process of locating a fast-speed pitch within a batter's strike zone is dependent primarily on controlling the speed of pitching wheel 112 to set the pitch speed, and the angle of the pitching machine 100 to control the pitch location.

Movement then of the pinch plate 106 into the off-speed pitch dynamics position slows the pitched ball by moving the pinch plate 106 further from the pitching machine wheel 112, where the travel distance and positioning of the pinch plate 106 is governed by the pinch plate support leg 110 and the slot 152 cut into the support leg 110. At the same time pinch plate support leg 124 increases the pitch trajectory angle allowing the off-speed pitch to arrive to the batter's strike zone. It is the length of the slot 150 cut into the pinch plate support leg 124 that governs the position of the forward portion of the pinch plate 106 and thus mostly controls the trajectory angle and pitch release point. Slot 150 in part enables the pitch trajectory angle to be increased thus compensating for the slower pitch speed and causing the off-speed pitch to arrive on target.

Though the lengths of the slots 150 and 152 cut into the pinch plate support legs 110 and 124 vary in location and length, with respect to brands and types of pitching machines being used, there is an interrelationship between the lengths of the slots 150 and 152, and the positioning of the pinch plate 106.

More specifically, the location and length of slots 150 and 152 are determined to allow the pinch plate support legs 110 and 124 to position the front edge, or the pitch release point edge, of the pinch plate 106 horizontal for fast-speed pitch dynamics pitches and at the appropriate angle for off-speed pitch dynamics pitches.

The location and length of slot 152 mostly controls the amount of pinch caused by the location of the rear or ball chute entry edge of the pinch plate 106, which in turn effects the ball speed. The combination of the location and lengths of slots 150 and 152 serve to orientate the pinch plate 106 mostly horizontal for fast-speed pitch dynamics pitches and orientate the pinch plate 106 at an angle to reduce the pitch speed, move the pitch release point, and the increase of the trajectory angle of the pitched ball for off-speed pitches. While maintaining pitch accuracy for fast-speed, and off-speed pitches relative to a batter's strike zone.

In a number of exemplary embodiments the length of slots 150 and 152 can vary based on pitch machine features, pitch dynamics device mounting requirements, and other factors. In a preferable embodiment the pinch plate support legs 110 and 124 are slide-ably fastened to the pitching machine 126 by way of bolts or other fastening means 128A and 128B. Pinch plate support leg 124 has a slot 150 cut into the leg 124. Pinch plate support leg 110 has a slot 152 cut into the leg 124.

A preferable length for slot 150 can be approximately three-quarters of an inch in length. A preferable length for slot 152 can be approximately one-half inch in length.

The lengths of slots 150 and 152 cut into pinch plate support leg 110 and 124 allow the pinch plate via handle 116 or knob 132, locking pegs 118A and 118B, and the alignment plate 120 to accurately position the pinch plate 106 in fast-speed and off-speed pitch positions, without requiring the changing of the pitching machine wheel 112 speed or requiring adjustment to tilt angle of pitching machine 100.

As such, the pitch dynamics device allows pitches with different pitch dynamics to be thrown to the batter with relative accuracy, easy, and without having to change pitching machine setup which may include recalibrating the pitching machine, throwing a series of test pitches to verify pitch accuracy, changing pitching machine wheel speed, or adjust pitching machine tilt angle.

Figure 1D:
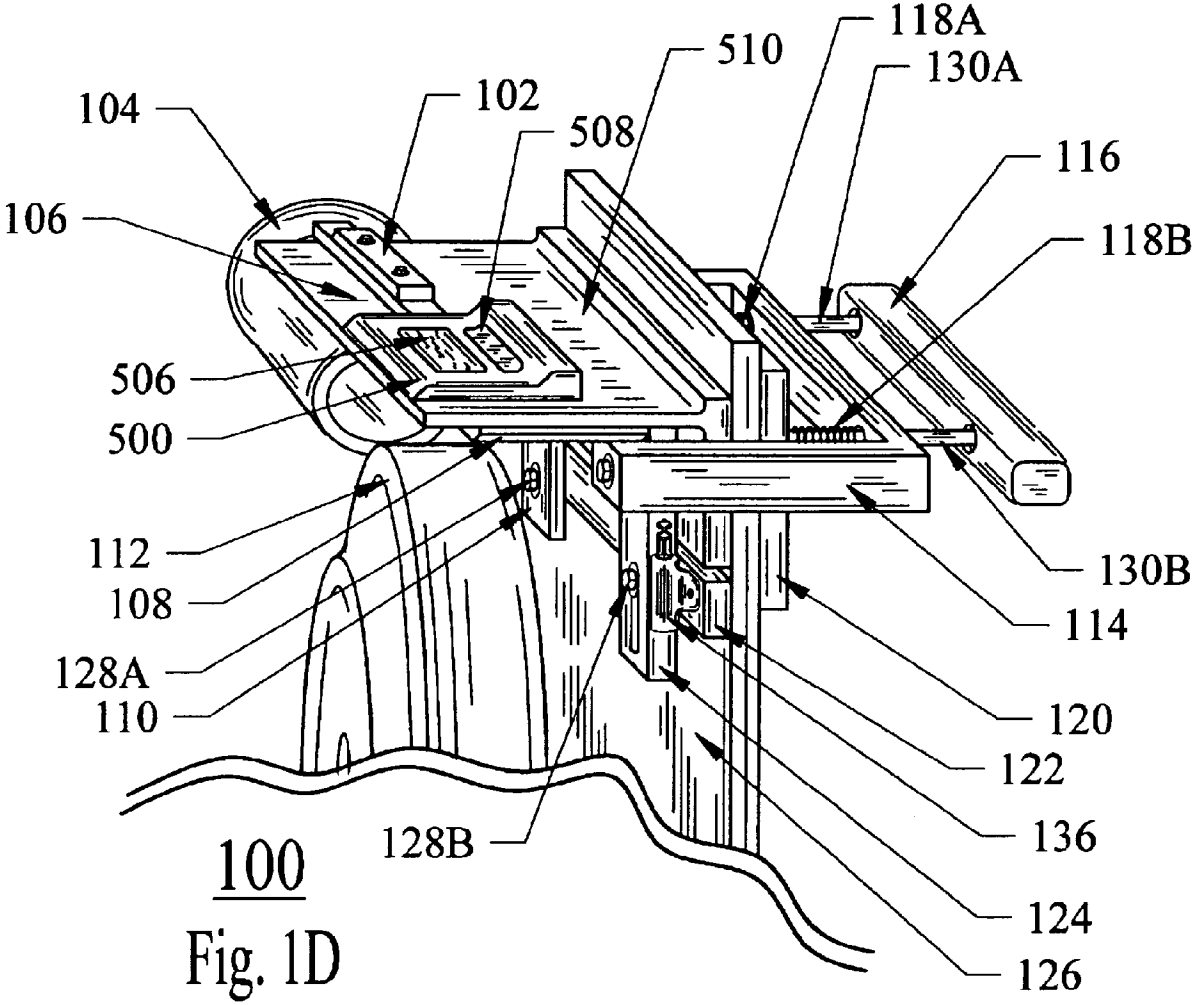
FIG. 1D shows a pitching machine 100 having a pitch dynamics device incorporating an electronic control system 500 and positioning device 136 attached thereto.
Figure 1E:
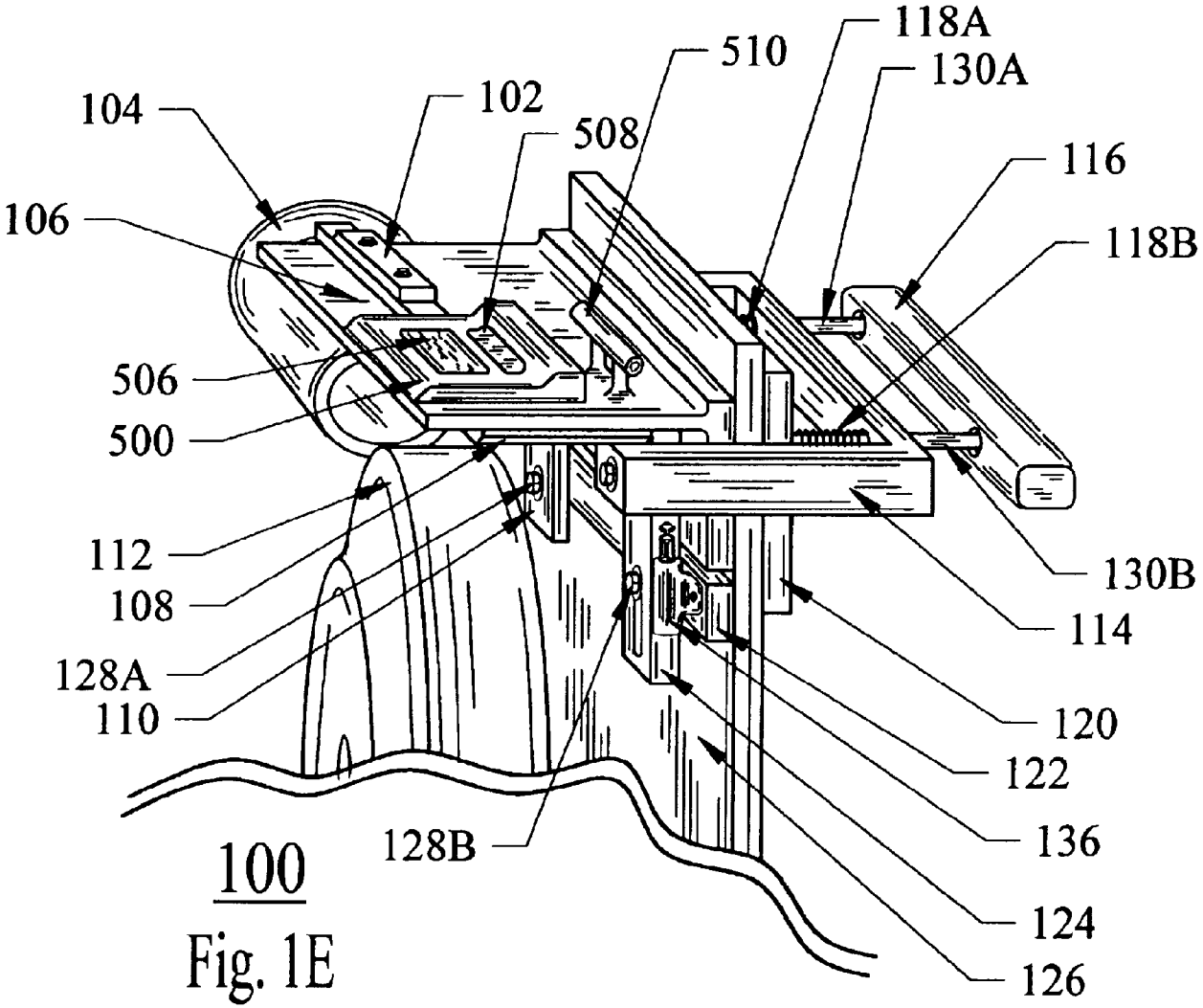
FIG. 1E shows a pitching machine 100 having a pitch dynamics device incorporating an electronic control system 500, positioning device 136, and hit pitch detector 510 attached thereto.
Figure 1F:
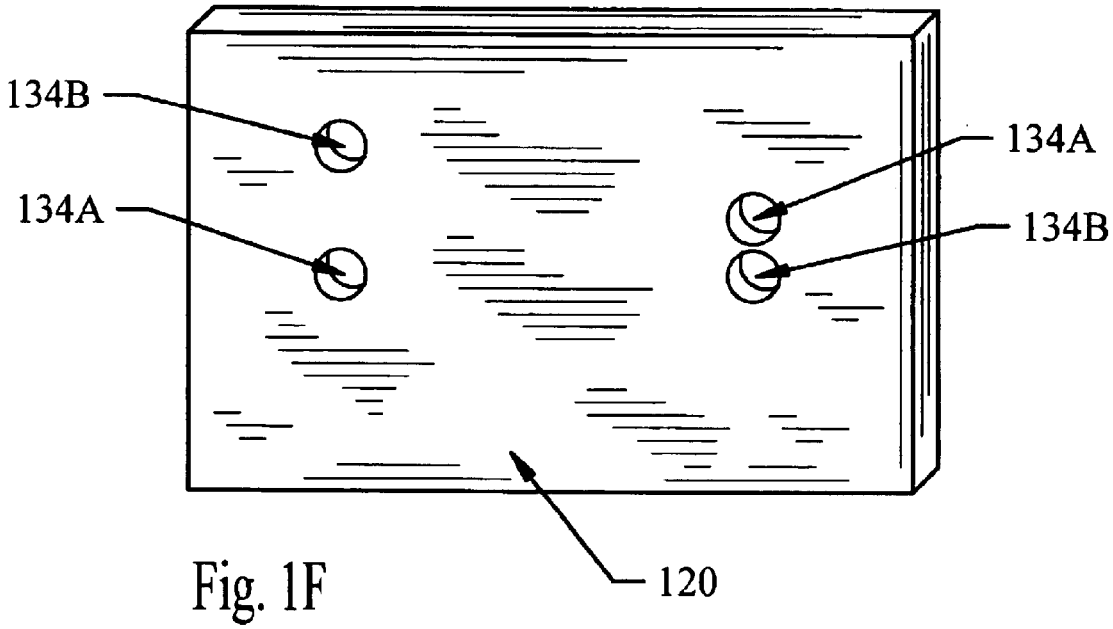
FIG. 1F shows the pitch dynamics device alignment plate 120.
Figure 1G:
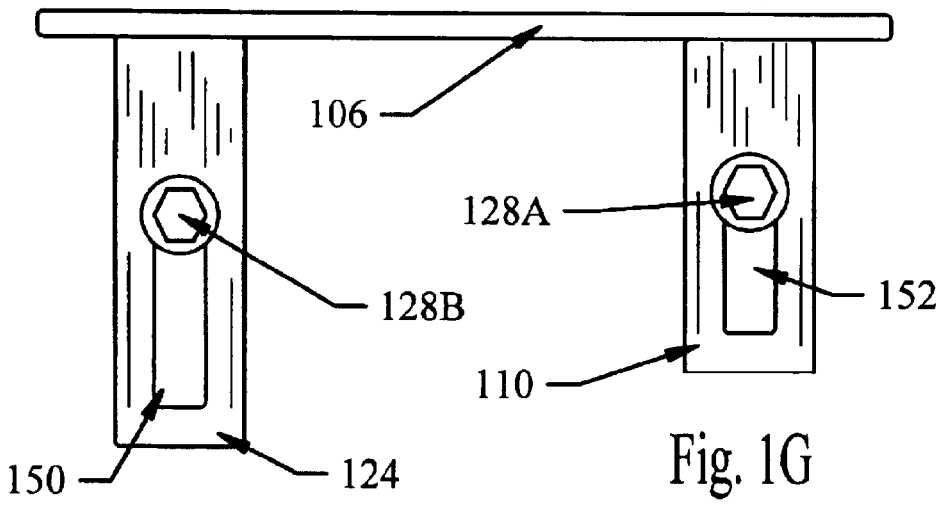
FIG. 1G shows the pitch dynamics device pinch plate 106 with pinch plate support legs 110 and 124 in a fast-speed pitch position.
Figure 1H:
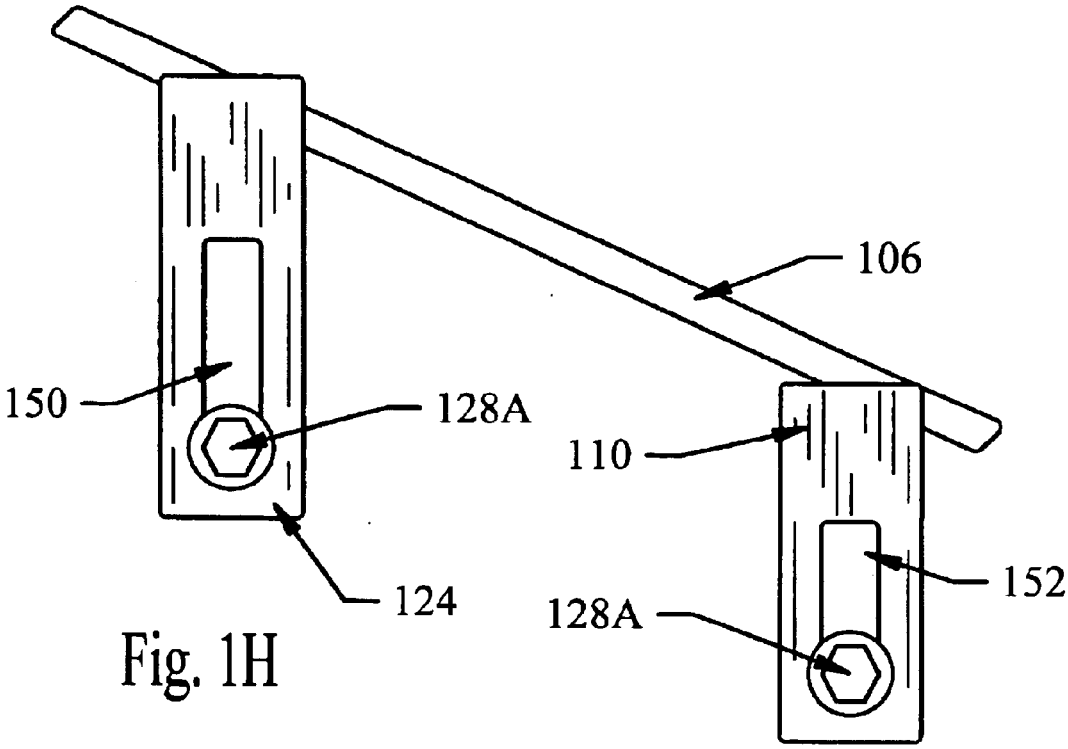
FIG. 1H shows the pitch dynamics device pinch plate 106 with pinch plate support legs 110 and 124 in an off-speed pitch position.

In addition to manual control of the positioning of the pinch plate 106, as shown in FIGS. 1A–1C, electronic and remote control of the positioning of the pinch plate 106 can also be effectuated in other exemplary embodiments including those embodiments shown in FIGS. 1D and 1E.

Referring to FIG. 1B there is shown a pitching machine 100 having a pitch dynamics device with knob embodiment attached thereto, with the pitch dynamics device shown in the fast-speed pitch position. In this exemplary embodiment, the strings 118A and 118B, locking pegs 130A and 130B, and handle 116 have been removed from the pitch dynamics device. To position and secure the pitch dynamics device in the fast-speed and off-speed pitch positions a knob 132 attached to a threaded locking peg 138 is utilized. In this regard, a user by rotating the knob 132 can loosen the pitch dynamics device assembly and position the pitch dynamics device accordingly. The user can then tighten by way of the knob 132 a locking peg 138 against and or into the alignment plate 120 such that pinch plate 106 and associated pitch dynamics device elements remain fixed and stationary in the appropriate positions. The knob 132, and locking pegs 130A, 130B, and 138 can be referred to as a positioning actuator.

Referring to FIG. 1C there is shown a pitching machine 100 having a pitch dynamics device with handle embodiment attached thereto, with the pitch dynamics device shown in the off-speed pitch dynamics pitch position. In the off-speed pitch position the pinch plate 106 edge closest to the ball entry chute 104 has been located further from the pitching wheel 112 to decrease the amount of pinch on the ball. The decreased pinch on the ball slows the pitch while the elevated front edge of pinch plate 106, the edge closest to the support 114, moves the pitch release point to an elevated angle, which causes the trajectory angle of the pitch to increase. As a result, the off-speed pitch arrives at approximately the same location as the fast-speed pitch, that location being preferably the batter's strike zone.

Referring to FIG. 1D shows a pitching machine 100 having a pitch dynamics device attached incorporating an electronic control system 500 and positioning device 136 attached thereto. In an exemplary embodiment, manual positioning control of the pitch dynamics device can be supplemented or eliminated with the addition of an electronic control system 500. In this regard, the electronic control system 500 having an optional keypad/touch pad 506, display 508, or other suitable, required or desires features to aid operation can be utilized to effectuate positioning of the pinch plate 106 and associated pitch dynamics device elements, by way of, a position control interface 512 and positioning device 136. Positioning device 136 can preferably be a cam, solenoid, or other similar or suitable mechanical positioning device. Positioning device 136 can be referred to as a positioning actuator.

In operation a user can interact with control system 500 to monitor batter's performance, track statistics, select pitch routines, select pitch types, pitch kinds, effectuate pseudo random pitch type selection, effectuate random pitch random pitch type selection, and or select other control system 500 options, pitching machine 100 options, and or pitch dynamics device options. In addition, control system 550 can utilize batter performance feedback and data to better select appropriate pitches. In addition, control system 500 can data communicate with other data processing devices locally and or remotely in a wired or wireless manner.

Referring to FIG. 1E there is shown a pitching machine 100 having a pitch dynamics device incorporating an electronic control system 500, positioning device 136, and hit pitch detector 510 attached thereto.

In an exemplary embodiment, the pitch dynamics device can include a hit pitch detector 510. In this regard, pitch dynamics device with control system 500 can utilize the hit pitch detector 510 to determine if the batter hit the pitch. Data processing can then be employed to determine if the pitching attachment device, by way of position control interface 512 and positioning device 136, needs to be changed. In operation, the hit pitch detector 510 can detect whether a batter hit a pitch. Batter performance data can then be utilized by the control system 500 to determine the batter's performance and effectuate a pitch routine appropriate for the batter.

As an example and not a limitation, a batter having trouble hitting fast-speed pitches as detected by the hit pitch detector 510 and electronic control system 500 may find that the electronic control system 500 has selected a more suitable pitching routine to better help the batter practice hitting fast-speed pitches.

Referring to FIG. 1F there is shown the pitch dynamics device alignment plate 120. The pitch dynamics device alignment plate 120 includes sets of holes for properly aligning the handle 116 or the knob 132, and the interconnected pinch plate 106 in the fast-speed and slow-speed pitch positions. In this regard, FIG. 1F shows a set of holes 134A, which receive locking pegs 130A and 130B to secure the pinch plate 106 in a mostly horizontal position. This mostly horizontal position enables the pitching machine 100 to throw fast-speed pitches. A set of holes 134B is utilized to receive locking pegs 130A and 130B to secure the pinch plate 106 in an elevated angle position. This elevated angle position enables the pinch plate to put less pressure on the ball slowing the pitch speed as well as moving the pitch release point to an elevated angle trajectory such that the off-speed pitch arrives at relatively the same position as the fast-speed pitch, that relative same position being preferably a batter's strike zone.

Pinch plate support legs 110 and 124, handle 116, handle support 114, pinch plate support 122, a knob 132, locking pegs 130A and 130B, a cam or solenoid or other similar or suitable positioning device 136 can be referred to as a positioning actuator.

Figure 2:
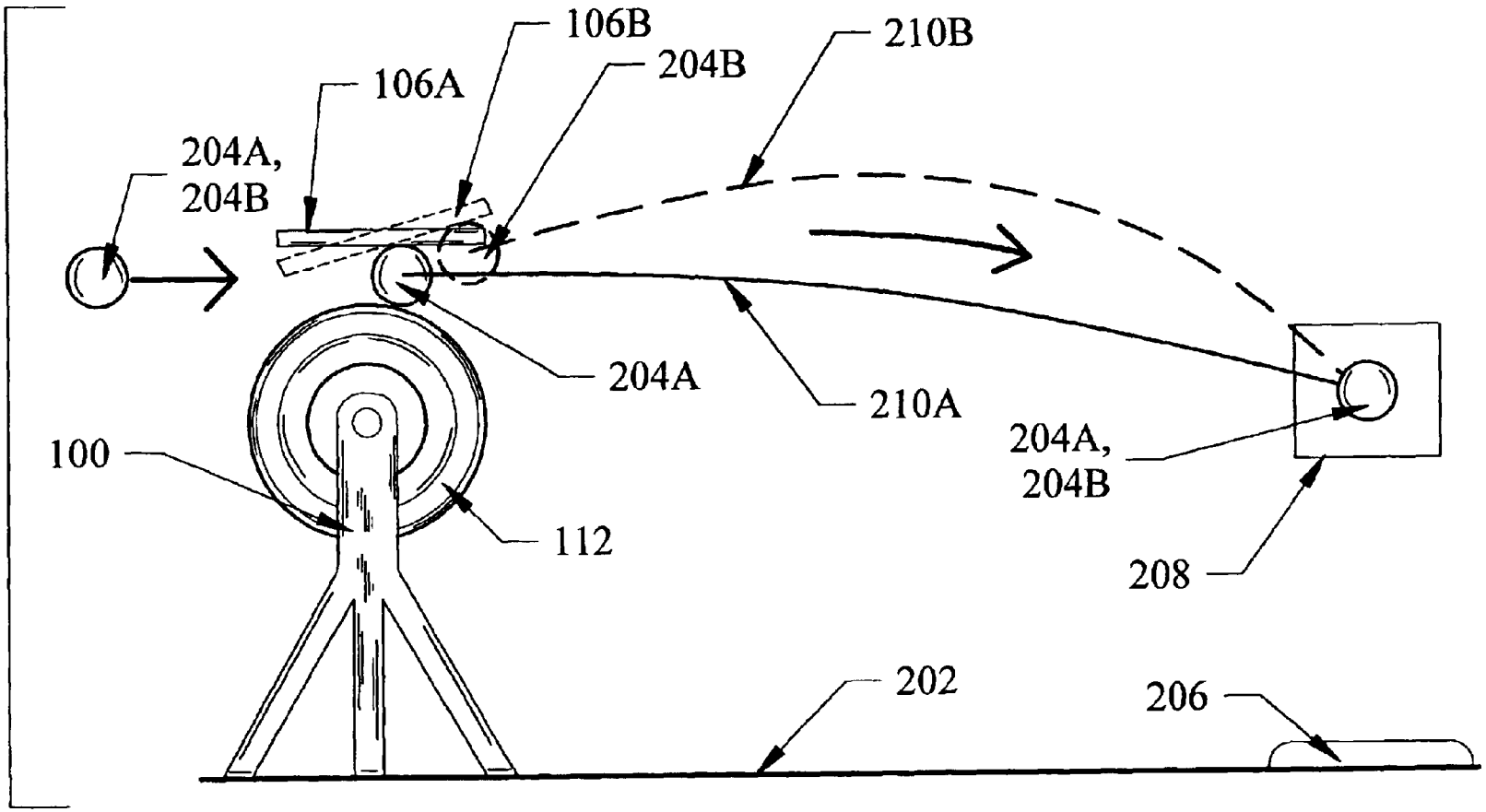
FIG. 2 shows an illustration of ball trajectory paths as related to the pinch plate 106 fast-speed pitch position 106A and off-speed pitch position 106B.

FIG. 2 better shows the positioning of pinch plate 106 (shown in FIG. 2 as 106A and 106B) in the mostly horizontal fast-speed pitch position, the elevated angle off-speed pitch position, and the effect such positions have on the trajectory of the pitch.

Referring to FIGS. 1G and 1H there is shown the pitch dynamics device pinch plate 106 with pinch plate support legs 110 and 124 in a fast-speed pitch position (FIG. 1G) and in an off-speed pitch (FIG. 1H).

FIG. 1G illustrate the mechanics of the pinch plate 106 positioned in the full-speed position. Pinch plate support legs are positioned to allow the top of the slot 152 in the pinch plate support leg 110 closest to the ball entry chute to touch its interconnecting bolt or other fastening means 128A, and to allow the top of the slot 150 in the pinch plate support leg 124 closest to the pitch point to touch its interconnecting bolt or other fastening means 128B.

In this fast-speed pitch position the pinch plate 106 is mostly horizontal. In determining the speed the fast-speed pitch, pitching machine 100 wheel 112 can be adjusted. The distance between the pinch plate 106 and the pitching machine wheel 112 is determined in part by the diameter of the ball being pitched. As such, typical settings include accommodations for a 12-inch softball, an 11-inch softball, and or a 9-inch baseball.

Typically for fast-speed pitches the pinch plate 106 is located at a minimum distance from the pitching machine wheel 112 and the trajectory angle is zero. In this regard, the pinch plate exerts a maximum and constant force on the ball from the entry chute 104 through the pitch release point. The pitch release point is typically defined as the point at which the pitched ball looses contact with the pitching machine 100.

FIG. 1H illustrates the mechanics of the pinch plate 106 in the off-speed position. Pinch plate support leg 110 is positioned to allow the bottom of the slot 152 in the pinch plate support leg 110 closest to the ball entry chute to touch its interconnecting bolt or other fastening means 128A, and to allow the bottom of the slot 150 in the pinch plate support leg 124 closest to the pitch point to touch its interconnecting bolt or other fastening means 128A. In this configuration, the angle of the pinch plate 106 typically controls the pitch release point.

FIG. 1H illustrates the mechanics of the pinch plate 106 in the off-speed position. Typically for off-speed pitches the pinch plate 106 is located at a maximum distance from the pitching machine wheel 112. This decreases the pinch pressure on the ball, which has the effect of slowing the pitch. Since the slot 150 length in the pinch plate support leg 124 (closest to the pitch point) is greater than the slot 152 length in the pinch plate support leg 110 (closest to ball entry chute 104) (in a preferred embodiment for example and not limitation three-quarters of an inch for slot 150 verse one half of an inch for slot 152) the pinch plate 106 trajectory angle is increased. Increasing the trajectory angle and slowing the ball speed enables the off-speed pitch to arrive at the batter in a hittable location, preferably the batter's strike zone.

Figure 1I:
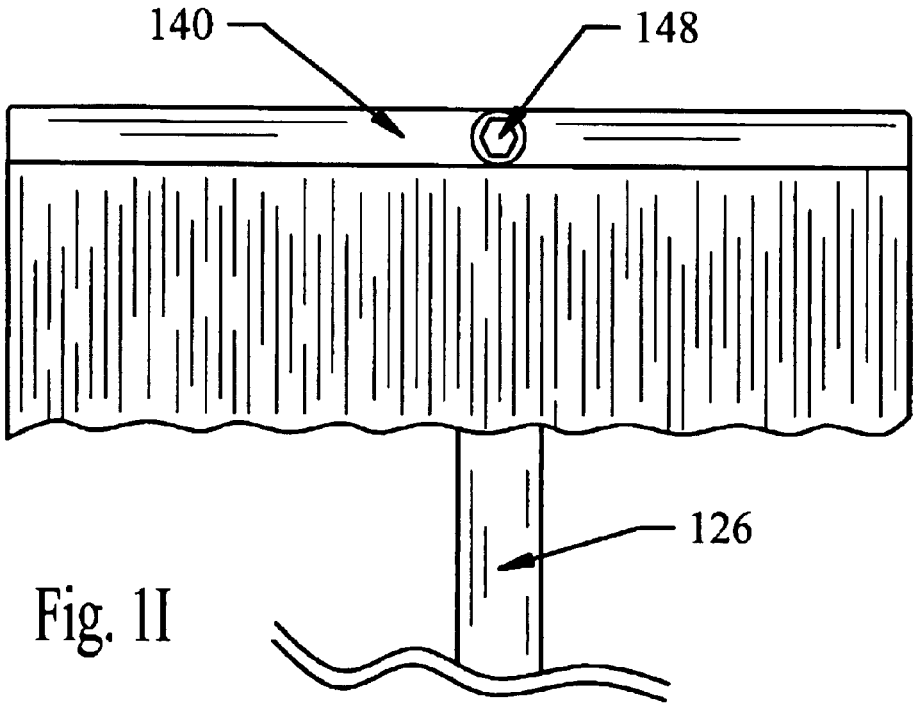
FIG. 1I shows the brush attachment for use with the pitch dynamics device.

Referring to FIG. 1I there is shown a brush attachment 140 for use with the pitching dynamics device. In an exemplary embodiment, as a way of disguising the positioning of the pinch plate 106 from batter a brush attachment or other disguising attachment 140 can be secured by way of a bolt or other fastening means 148 to the pitching machine support bracket 126 or secured to other suitable locations on the pitching machine 100. Disguising the positioning of pinch plate 106, from the batter, can keep the batter guessing as to what the next pitch will be.

When the pitch dynamics device is utilizing the electronic control system 500 where the positioning of pinch plate 106 can be effectuated by way of electronic control or remote control the advantage of having a brush attachment 140 or similar attachment can be that the batter will not know what the next pitch type (fast-speed or off-speed pitch) is going to be.

In general, the batter's experience in hitting a variety of pitches without the knowledge of which pitch type is coming next can better simulate conditions a batter may typically face in game situations. As such, a pitch dynamics device that can conceal the type of pitch being thrown can significantly enhance the batter's learning, practice, and skills with respect to batting in game situations.

Figure 1J:
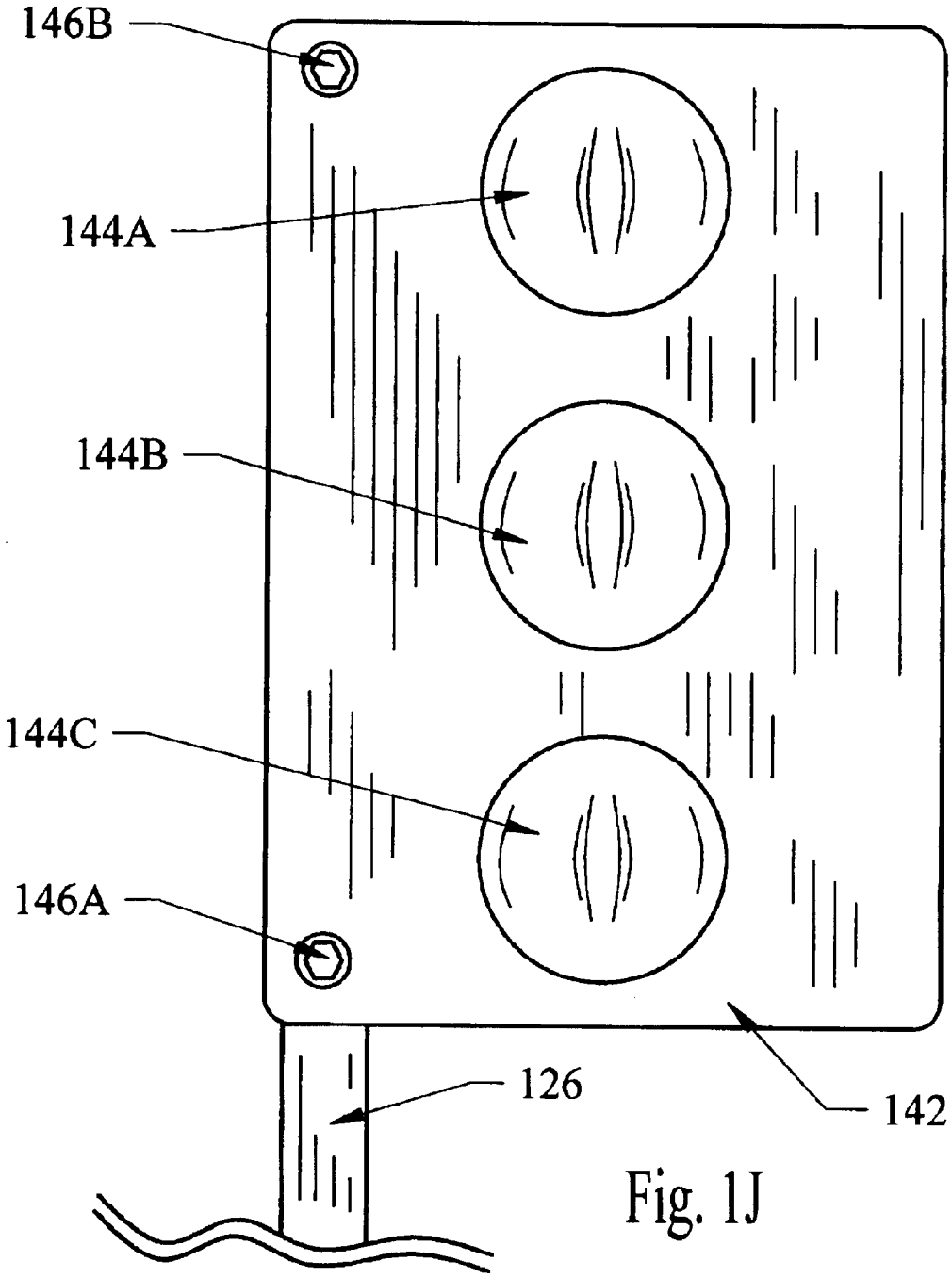
FIG. 1J shows the tree-light attachment for use with the pitch dynamics device.

Referring to FIG. 1J there is shown a tree-light attachment for use with a pitching attachment device. In an exemplary embodiment a tree-light attachment can be utilized to indicate to the batter when a pitch is about to be thrown, is on its way, and or when to swing at the pitch. As such, the tree-light attachment can be utilized with the pitching machine 100 and the pitch dynamics device to aid in better training a batter to be prepared, and to swing at the appropriate time to hit the pitch.

Shown in FIG. 1J is a tree-light attachment. The tree-light attachment includes a mounting bracket 142 which can be typically secured to the pitching machine support bracket 126 or other suitable pitching machine 100 area by way of bolts or other fastening means 146A and 146B. The tree-light attachment also includes provisions for a plurality of lights. The plurality of lights can include lights 144A, 144B, and 144C. In different embodiments a different number of lights and different colors of lights can be utilized.

For example and not limitation, a red lamp can be used for light 144A indicating to the batter that he/she is to wait for the pitch to be thrown. A yellow light can be utilized for light 144B to indicate to the batter that the pitch is in route. A green light can be utilized for light 144C to indicate to the batter that it is time to swing at pitch.

As such a normal operating sequence could see the red light 144A turn on first followed by the yellow light 144B turning on second and a green light 144C turning on third. From the batter's perspective and as a training aid for the batter the tree-light attachment can indicate when to be ready for the pitch, when to watch for the pitch in route, and when to swing at the pitch.

Referring to FIG. 2 there is shown an illustration of ball trajectory paths as related to the pinch plate 106 fast-speed position 106A and off-speed pitch position 106B.

A first positioning of the pinch plate 106 is shown in the mostly horizontal position or fast-speed pinch plate position 106A. Following the path of a pitched ball to, through, and over the pitching machine wheel 112 the exit trajectory follows path 210A to its destination location, which can be the batter's strikes zone indicated as strike zone 208. The batter's strike zone is shown somewhere in close proximity to where a batter stands shown as batter position 206 also referred to as home plate 206. The pitched ball travels over a distance from the pitching machine 100 to home plate 206, which is indicated as a solid connecting path 202.

A second positioning of the pinch plate 106 is shown in the off-speed pitch position as pinch plate position 106B. Following the path of the pitched ball, through, and over pitching machine wheel 112 the exit trajectory is elevated with respect to the fast-speed pitch path 210A. The elevated trajectory is shown as path 210B. As such, the pinch plate 106B positioning has slowed at the ball 204B by decreasing the amount of pinch between the pinch plate 106B and the pitching machine wheel 112 while increasing the trajectory angle such that the trajectory path 210B of the off-speed pitch arrives at relatively the same position, which is at strike zone 208.

Figure 3:
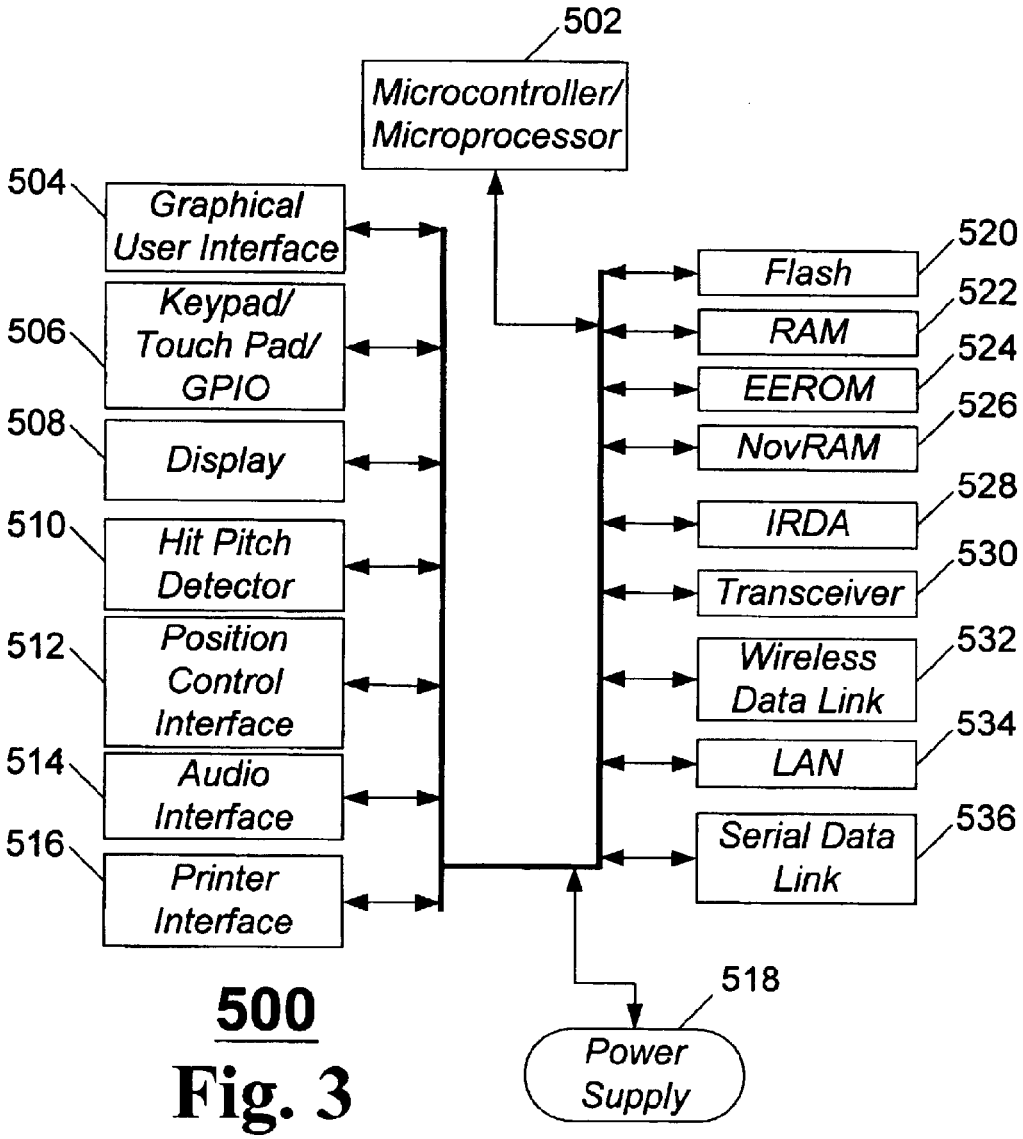
FIG. 3 shows a system block diagram of the electronic control system 500.

Referring to FIG. 3 there is shown a system block diagram of the electronic control system 500. In an exemplary embodiment, an electronic system 500 can be incorporated into a pitching machine 100 and or pitch dynamics device. In such an embodiment the electronic system 500 can activate, monitor, provide computation results, store results, data process locally remotely wired or wirelessly, and or provide other data processing and or control capabilities.

A power supply 518 can include alternating current (AC), direct current (DC), batteries, solar cells, and or other similar or suitable power supply as may be required or desired in the embodiment. The keypad/touch pad/general purpose input output (GPIO) 506 can include push buttons, momentary push buttons, digital inputs and outputs, analog inputs and outputs, and timers to govern the activation and control of the interconnected pitch dynamics device and control system 500.

Interconnected with a microcontroller 502 can be flash memory 520, random access memory (RAM) 522, electrically erasable read only memory (EEROM) 524, and non-volatile random access memory (NOVRAM) 526. In addition, a graphical user input interface 504 can be interconnected with a microcontroller 502. In an exemplary embodiment microcontroller 502 can be an INTEL X scale, strong arm, PENTIUM, x86, MICROCHIP, AMD, ZILOG, MOTOROLA POWERPC, 68 HC, ARM, HITACHI, RABBIT, SANYO and or other similar, or suitable microcontroller. A microprocessor can be referred to as a microcontroller, and or microcontroller 502. Microcontroller 502 can also incorporate memory. Such memory can include read only memory (ROM), random access memory (RAM), flash memory, Serial I2C flash memory, and other types, kinds, similar, and or suitable memory.

Furthermore, an electronic system 500 can operate on an embedded binary input-output system (BIOS) including a PC BIOS and can run embedded system operating systems. Embedded system operating systems (OS) can include OSEK, OSEK/VDX, PALM OS, LINUX, WINDOWS 9x, WINDOWS 2000, WINDOWS CE, XP, NT, embedded NT, MIRA, QNX NEUTRINO, and other embedded system operating systems. In addition, development tools and application software can include MICROSOFT VISUAL STUDIO development tools, assemblers, C language compilers, cross-assemblers, VIRTUAL JAVA MACHINE (JVM) development tools and application software, and other development tools and application software.

A graphical user input interface 508 can include user input devices. Such user input devices can include key entry, biometric input, push button input, touch pad/screen, optical sensing, capacitive sensing, or other suitable or desirable graphical user interface devices or options.

Also interconnected with a microcontroller 502 can be a display 508, a hit pitch detector 510, a position control interface 512, and audio interface 514, an optional printer interface 516, and a plurality of data communication interfaces. Such plurality of data communication interfaces can include an infrared (IRDA) interface 528, a transceiver 530, a wireless data link 532, a local area network interface (LAN) 534, or a serial data link 536.

A display 508 can include a variety of user feedback devices. Such user feedback devices can include liquid crystal display (LCD), light emitting diodes (LED), organic light emitting diodes (OLED), polymer light emitting electrochemical cells (LECs), and or other similar, suitable, required, and or desired user input interface devices.

A hit pitch detector 510 can be utilized to acoustically, optically, electronically, and or by way of other similar, suitable, desired, and or required methods monitor thrown pitches to determine if a batter hits the pitch. Such hit pitch determinations can be utilized by the control system 500 to make certain determinations as to which pitch to throw next and can provide batter performance data as may be required or desired.

A position control interface 512 can be utilized to provide electrical control to position control devices, such as position device 136. In this regard, control system 500 by way position control interface 512 can control position device 136 to position the pinch plate 106. As such control system 500 can determine and position the pinch plate 106 to control the pitch dynamics of pitched balls as may be required, and or desired.

An audio interface 514 can be utilized to provide audio feedback and sounds as may be required, and or desired in certain embodiments. In this regard, audio can be provided to the operator and or batter.

An optional printer interface 516 can be utilized to provide printed batter performance out, control system 500 data, and or for other similar suitable, required and or desired applications.

The plurality of data communication interface (528, 530, 532, 534, and 506) can include a plurality of devices and interfaces to effect data communication with other data processing resources. Such devices and interfaces can include wired and wireless wide area networking (WAN) and local area networking (LAN) data communications and interfaces. Such WAN and LAN data communications can be by way of proprietary wireless standards and protocols, Institute of Electronics Engineers (IEEE) wireless protocols and standards, ETHERNET, FIREWIRE, 3COM devices, wireless standards and protocols, SIERRA, WIRELESS devices, a WISMO device, wireless standards, and protocols wireless application protocol (WAP), CDPD, PCS, WCDMA, TDMA, TDD, CDMA, CDMA 2000, GSM, 1X 3G, general packet radio service (GPRS), enhanced data rates for global evolution (EDGE), TDMA, 2G/2.5G type communication ('G' is an abbreviation for generation—for example, 2G is second generation technologies), 3G and 4G type communication, infrared data communication (IRDA), IEEE 802.11'x' ('x' meaning all types and kinds of 802.11 standards and protocols including 'a', 'b', and 'g'), WI-FI, INTEL PRO/WIRELESS 5000 LAN, BLUE TOOTH compliant standards and protocols, small device microwave, spread spectrum, 2.4 GHZ, 5 GHZ, 900 MHZ, a single frequency transceiver, a dual frequency transceiver, Internet service provider (ISP), a TCP/IP connection, a PPP, SLIP, or SOCKET layer connection, a RAS connection, by utilizing wireless Internet standards or protocols, or other Internet connection points or connection types or other suitable wireless standards, frequencies, or protocols. Other wired data communications can include RS232 and RS485 communications as well as universal serial bus (USB) and or other similar or suitable types and kinds of data communication interfaces.

Data communications between the system 500 in a wired and or wireless manner can be effectuated with other data processing devices such as personal computer (PC) 308, personal data assistant (PDA) 306, wireless key fob 310, data processing device 304, a global network based data processing resource 302 and or other microprocessor based systems and can enable data to be exchanged between the system 500 and or local or remote data processing resources. Such data communications can include software applications to be run by the electronic system 500, data processing tasks that can improve electronic system 500 operations and functionality, external data processing device operations or functionality, and or other similar, suitable, desired, and or desired data processing activities.

When an electronic system 500 is embodied as part of a pitch dynamics device data processing tasks can include and not be limited to monitoring batter performance, track statistics, select pitch routines, select pitched types, pitch kinds, effectuate pseudo random pitch selection, effectuate random pitch selection, and or select other control system 500 options, pitching machine 100 options, and or pitch dynamics device options. In addition, control system 500 can operate on batter performance data to better selected appropriate pitches for certain matters, and data communicate to other data processing devices locally and or removably in a wired or wireless manner.

Figure 4:
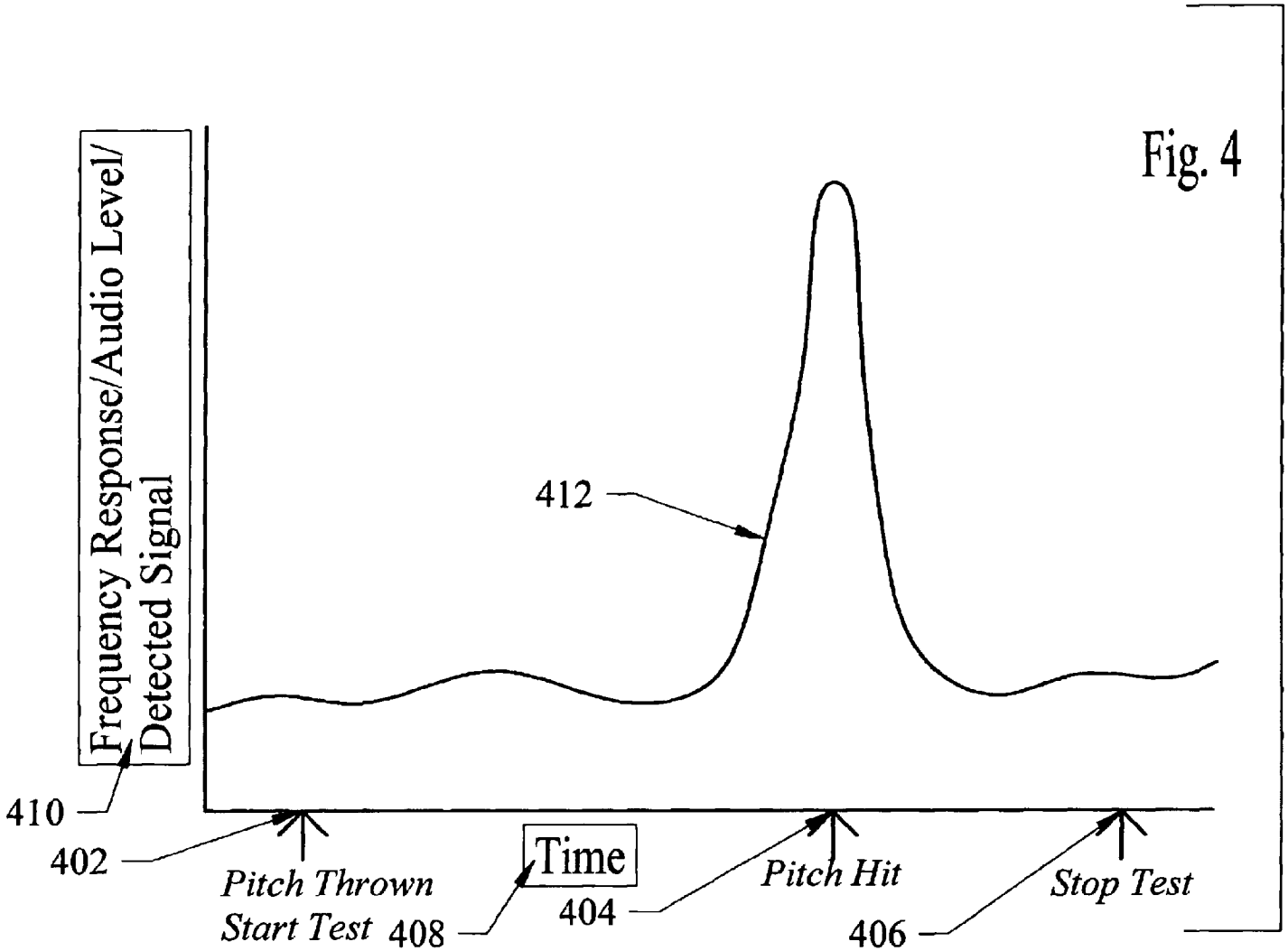
FIG. 4 shows a hit pitch detector response graph illustrating detection of the batter hitting the thrown pitch.

Referring to FIG. 4 there is shown a hit pitch detector response graph illustrating detection of the batter hitting the thrown pitch. In an exemplary embodiment, the pitch detector 510 can utilize acoustical, optical, ball implants, and or other similar or suitable means to detect whether the batter hit the pitch thrown by a pitching machine 100. In this regard, control system 500 can detect the pitch being thrown and start an interval timer. The interval timer begins timing when the pitch is thrown. This PITCH THROWN START TEST 402 timer is utilized to begin monitoring the hit pitch detector 510. For a suitable period of time the hit pitch detector 510 is monitored to determine if the batter hit the pitch. This suitable length of time is long enough to allow the thrown pitch to reach the batter and to allow the batter time to hit the pitch. The suitable length of time can be referred to as the STOP TEST 406 time. If the batter hits the pitch between the PITCH THROWN START TEST 402 time period and the STOP TEST 406 time period the responses graph 412 can indicate the response of a pitch being hit. Referring to FIG. 4 in an exemplary embodiment such a response graph 412 could indicate a pitch hit, such as PITCH HIT 404, by way of a deflection or other indication in the response graph 412.

Referring to FIG. 4 the response graph 412 has been plotted from data obtained from a hit pitch detector 510 as a function of FREQUENCY RESPONSE/AUDIO LEVEL/DETECTED SIGNAL LEVEL 410 verse TIME 408. In a plurality of exemplary embodiments a variety of response graphs can be charted, graphed, or otherwise monitored to determine when a pitch has been hit.

Figure 5:
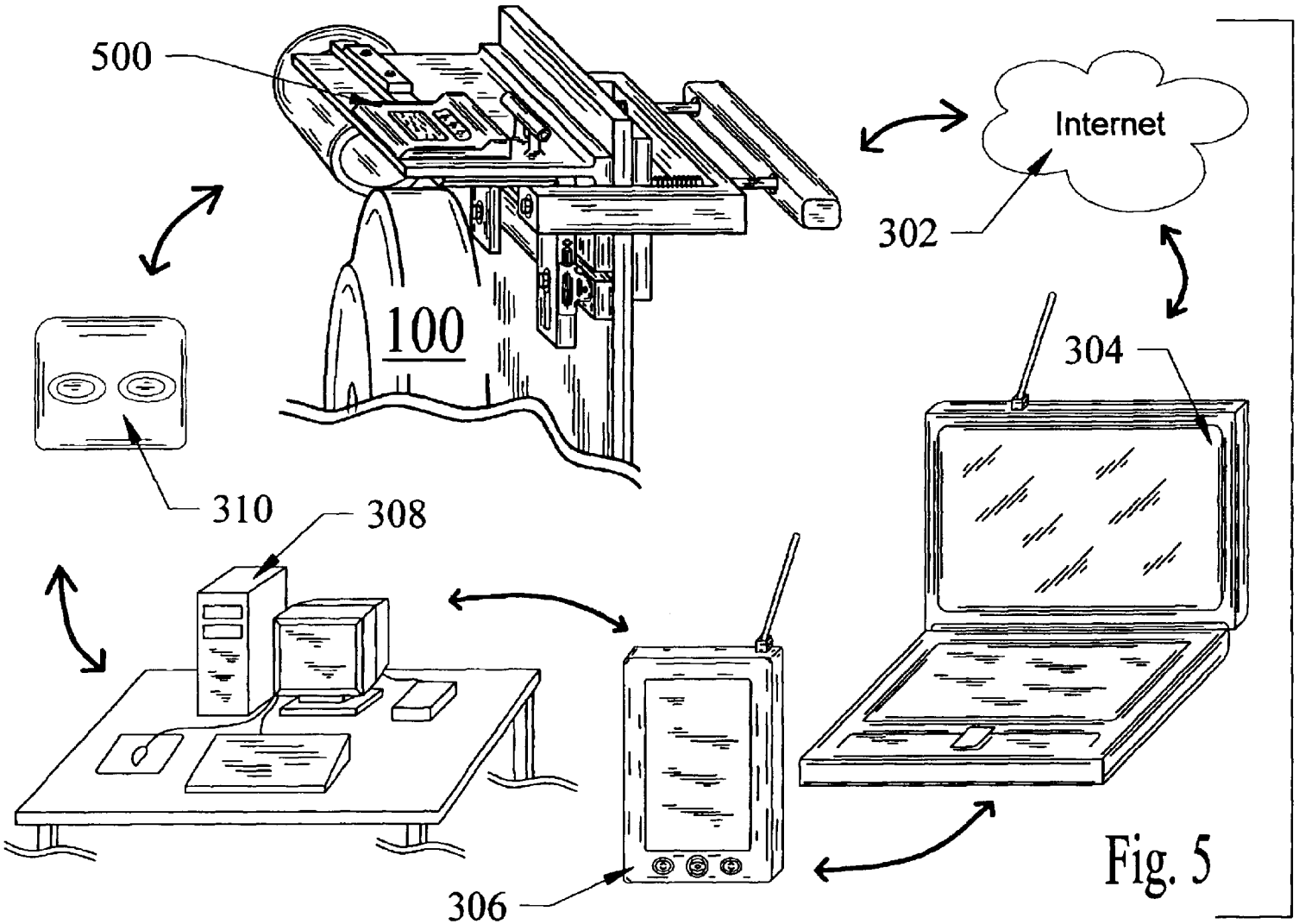
FIG. 5 shows the data connectivity between data processing devices, the pitch dynamics device, and a global network.

Referring to FIG. 5 there is shown the data connectivity between data processing devices, the pitch dynamics device, and a global network. FIG. 5 illustrates electronic control system 500 data communication with a plurality of data communicating devices, and electronic system 500 data communication over a global network to remote global network based data processing resources. In an exemplary embodiment, electronic control system 500 can data communicate directly with data processing devices such as key fob 310, PC 308, a global network data processing resource having data communication access over a global network 302 also referred to as the internet 302, PDA 306, and or data processing device 304.

In another exemplary embodiment the electronic system 500 can data communicate indirectly via a LAN or WAN data communication connection, including data communication over a global network. The Internet can be referred to as a global network. As such, the electronic system 500 can data communicate over a WAN data connection, including over Internet 302, to data communicating devices such as wireless key fob 310, PC 308, a global network data processing resource 302, PDA 306, and or data processing device 304.

Figure 6:
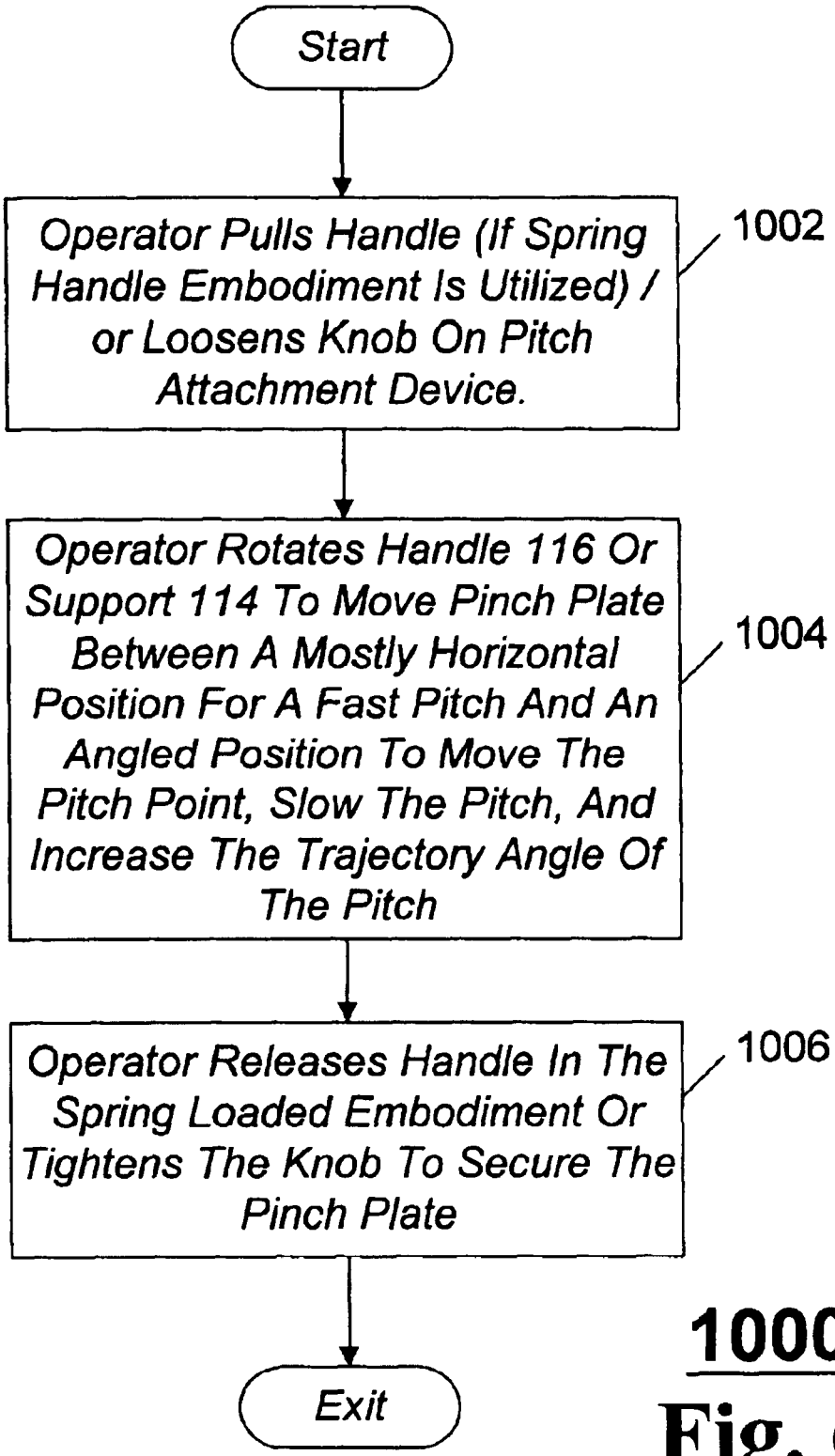
FIG. 6 shows a flowchart 1000 detailing steps to change the position of the pinch plate 106 to effectuate a change of pitch dynamics resulting in a change in the type of pitch thrown.

Referring to FIG. 6 there is shown a flowchart 1000 detailing steps to change the position of the pinch plate 106 to effectuate a change of pitch dynamics resulting in a change in the type of pitch thrown. In an exemplary embodiment, an operator can manually adjust the pitch dynamics device by slightly moving the handle 116 and rotating the pinch plate 106 into the desired position or by loosening the knob 132 and rotating the pinch plate 106 into the desired position. Routine 1000 details this process. Processing begins in block 1002.

In block 1002 the operator pulls the handle 116 if the handle embodiment is utilized or the operator loosens the knob 132 on the pitch dynamics device if the knob embodiment is utilized. Processing then moves to block 1004.

In block 1004 the operator rotates the handle 116 if available or moves support 114 to position the pinch plate 106 between a mostly horizontal position for a fast-speed pitch and an angled position to move the pitch release point forward, slow the pitch, and increase the trajectory angle of the pitch to create an off-speed pitch. Processing then moves to block 1006.

In block 1006 the operator then releases the handle 116 if available, or tightens the knob 132 if available to secure the pinch plate 106 into the desired position. The routine is then exited.

Figure 7:
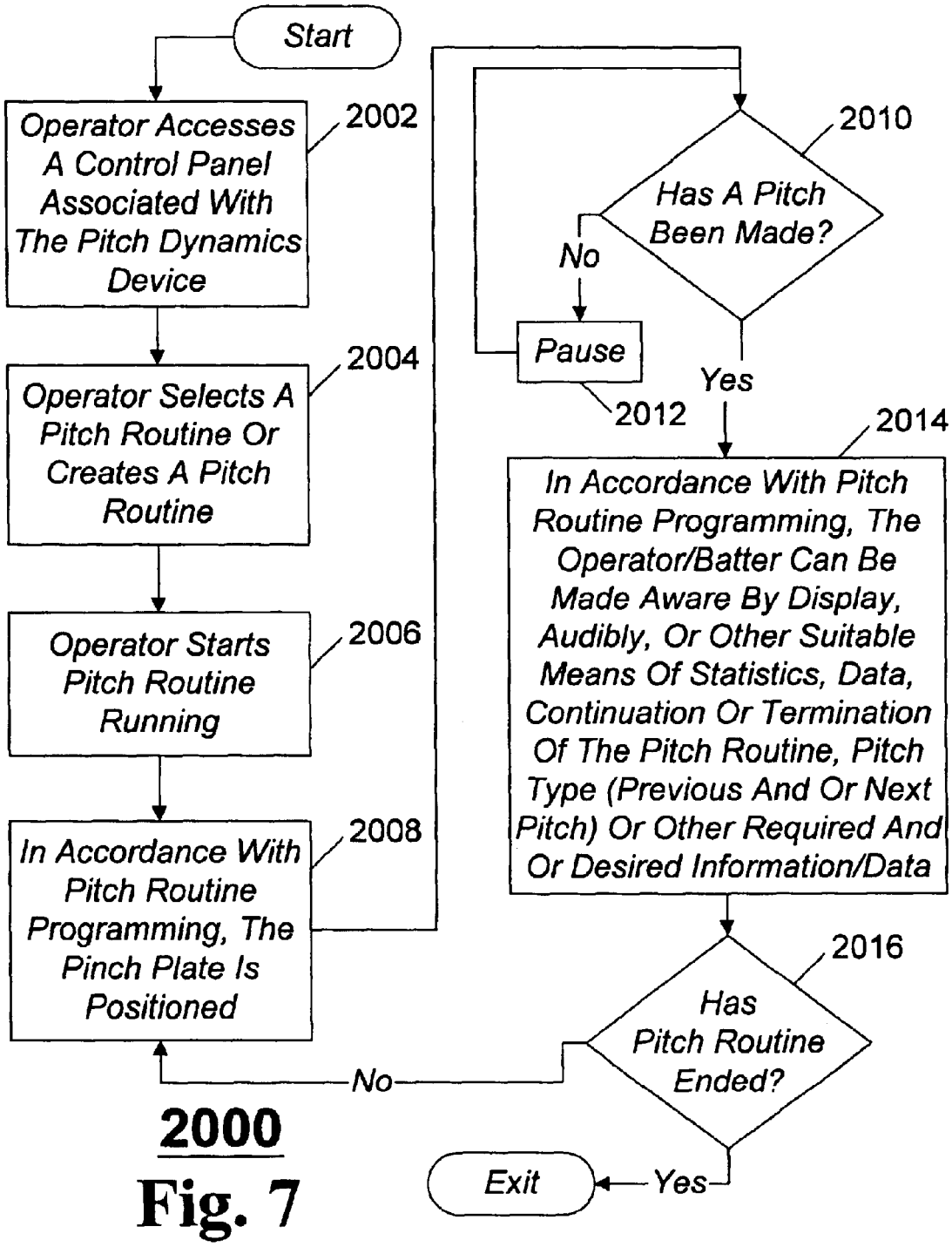
FIG. 7 shows a flowchart 2000 detailing the programming and operation of a pitch routine with a pitch dynamics device having an electronic control system 500.

Referring to FIG. 7 there is shown a flowchart 2000 detailing the programming and operation of a pitch routine with a pitch dynamics device having an electronic control system 500. In an exemplary embodiment, a control system 500 can be incorporated with the pitch dynamics device. In this regard, the control system 500 can be utilized to automate the positioning of the pinch plate 106. Furthermore, such automation of the positioning of the pinch plate 106 can be done under program control where pitch routines, operator programming, and other data processing steps can be employed in the selection of when and how to position the pinch plate 106. Processing begins in block 2002.

In block 2002 the operator accesses a control panel associated with the pitch dynamics device. The control panel can be part of control system 500 and allows the operator to control, program, monitor, view data, or otherwise interact with the control system 500. Processing then moves to block 2004.

In block 2004 the operator can select a pitch routine or create a pitch routine, which can be utilized, to determine how many and which pitch types (fast-speed or off-speed pitches) will be thrown to the batter. In this regard, the pitch routines can include for example and without limitation, the number of pitches to throw, the types of pitches to throw, the rules or criteria with which a pitch selection will be made, and or other desired or required elements that may be required in the pitch routine. Processing then moves to block to 2006.

In block 2006 the operator starts the pitch routine running. In an exemplary embodiment, the starting of a pitch routine can include resetting counters and or performing other pitch routine initializations or sequences. Processing then moves to block the 2008.

In block 2008 in accordance with pitch routine programming, the pitch plate 106 is positioned and the pitching machine prepared to pitch the first ball. Processing then moves to decision block 2010.

In decision block 2010 a determination is made as to whether a pitch has been made. If the resultant is in the affirmative that is a pitch being made has been detected processing then moves to block 2014. If the resultant is in the negative that is a pitch has not been detected being made then processing moves to block 2012 where a brief pause is encountered and processing is returned to decision block 2010.

In block 2014 in accordance with pitch routine programming the operator and or batter can be made aware by display, audibly, or other suitable means of statistics, data, continuation or termination of the pitch routine, pitch type (previous and or next pitch) or other required and or desired information and or data. Processing then moves to decision block 2016.

In decision block 2016 a determination is made as to whether the pitch routine has ended. If the resultant is in the affirmative that is the pitch routine has ended then the routine is exited. If the resultant is in the negative that is the pitch routine has not ended then processing is returned to block 2008.

Figure 8A:
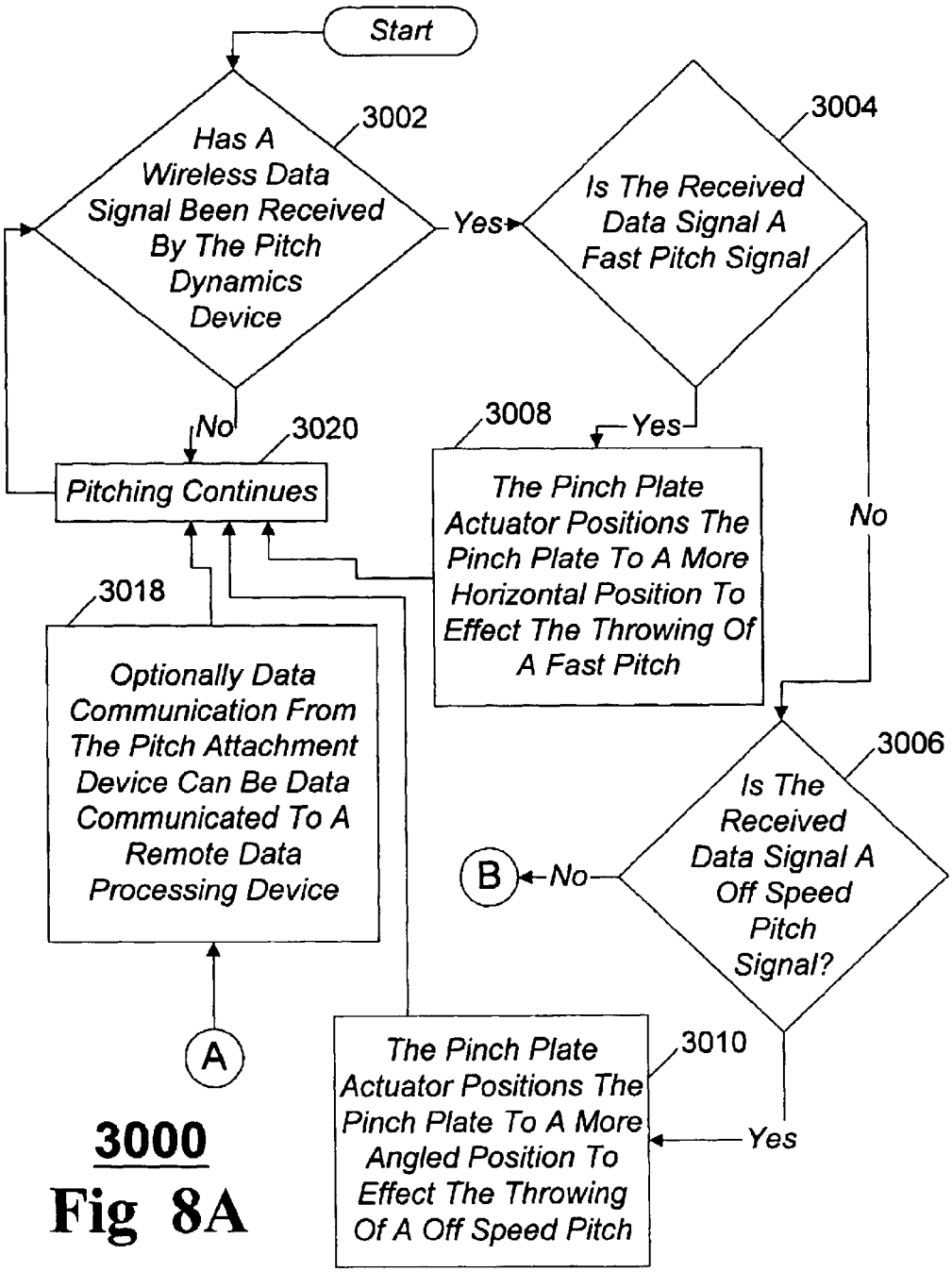
FIGS. 8A and 8B show a flowchart 3000 detailing the utilization of a wireless device to, in real time, select the pitch type to be thrown.
Figure 8B:
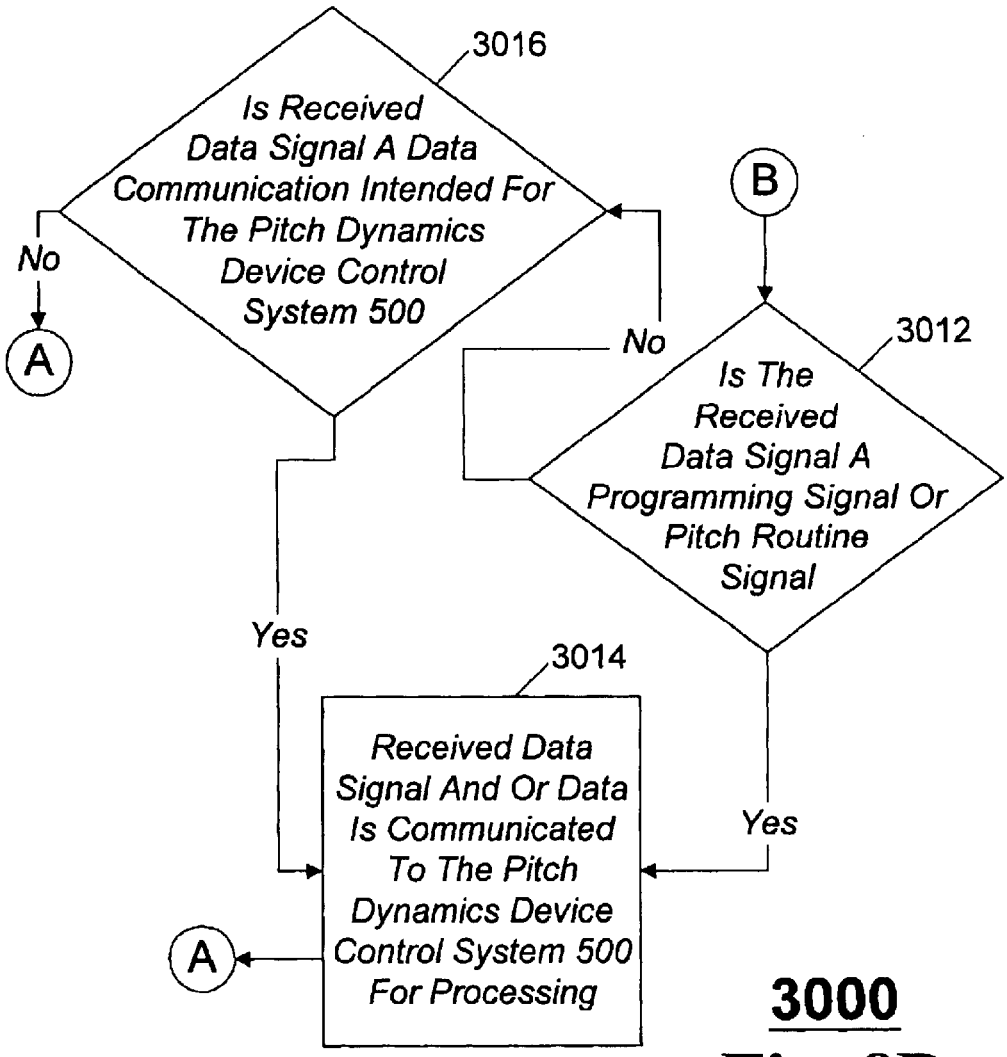

Referring to FIGS. 8A and 8B there is shown a flowchart 3000 detailing the utilization of a wireless device to, in real time, select the pitch type to be thrown. In an exemplary embodiment, there may be times when a coach or some other personnel may desire to manually control remotely the pitch being selected and pitched to a batter. In this regard, for example and not limitation, a coach sitting in the dugout may be watching a batter bat. The coach may determine that the batter needs to see more fast-speed pitches. The coach having made the decision then operates a wireless device which signals the pitching machine and pitch dynamics device by way of an interconnected control system 500 to position the pinch plate 106 by way of position control interface 512 and positioning device 136 in the fast-speed pitch position. The next pitch thrown to the batter is then a fast-speed pitch.

In other exemplary embodiment a coach may decide which pitching routine is most appropriate for a certain batter and by way of a remote wireless device send a data signal to the pitching machine 100 effectuating the pitch dynamics device and interconnected control system 500 to begin executing the selected and or desired pitch routine. Processing begins in decision block 3002.

In decision block 3002 a determination is made as to whether a wireless data signal has been received by the pitch dynamics device. More specifically, a determination is made by the interconnected control system 500, which is part of the pitch dynamics device. If the resultant is in the affirmative that is the pitch dynamics device has received a wireless data signal processing then processing moves to decision block 3004. If the resultant is in the negative that is the pitch dynamics device has not received a wireless data signal then processing moves to block 3020.

In decision block 3004 a determination is made as to whether the received data signal is a fast-speed pitch signal. If the resultant is in the affirmative that is the received data signal is a fast-speed pitch signal then processing moves to block 3008. If the resultant is in the negative that is the received data signal is not a fast-speed pitch signal then processing moves to decision block 3006.

In block 3008 by way of position control interface 512, the pinch plate positioning device 136 positions the pinch plate 106 to a more horizontal position to affect the throwing of a fast-speed pitch. Processing then moves to block 3020.

In decision block 3006 a determination is made as to whether the received data signal is an off-speed pitch signal. If the resultant is in the affirmative that is to received data signal is an off-speed pitch signal then processing moves to block 3010. If the resultant is in the negative that is the received data signal is not an off-speed pitch signal then processing moves to decision block 3012.

In block 3010 by way of position control interface 512 the pinch plate positioning device 136, positions the pinch plate 106 to a more angled position to affect the throwing of an off-speed pitch. Processing then moves to block 3020.

In decision block 3012 a determination is made as to whether the received data signal is a programming signal or pitch routine signal. If the resultant is in the affirmative that is the received data signal is a programming signal or pitch routine signal then processing moves to block 3014. If the resultant is in the negative that is to received data signal is not a programming signal or a pitch routine signal then processing moves to decision block 3016.

In block 3014 the receive data signal and or data is communicated to the pitch dynamics device electronics control system 500 for processing. Processing then moves to block 3018.

In decision block 3016 a determination is made as to whether the received data signal is a data communication intended for the pitch dynamics device electronic control system 500. If the resultant is in the affirmative that is the received data signal is a data communication intended for the pitch dynamics device electronics control system 500 then processing moves to block 3014. If the resultant is in the negative that is the received data signal is not a data communication intended for the pitch dynamics device electronics control system 500 then processing moves to block 3018.

In block 3018 optionally data communication from the pitch dynamics device can be data communicated to a remote data processing device. In this regard, bidirectional data communication between the pitch dynamics device control system 500 and other data processing devices can be effectuated. Such bidirectional data communication can be local, remote, wired, or wireless data communications. Processing then moves to block 3020.

In block 3020 pitching continues and processing moves back to decision block 3002.

Figure 9:
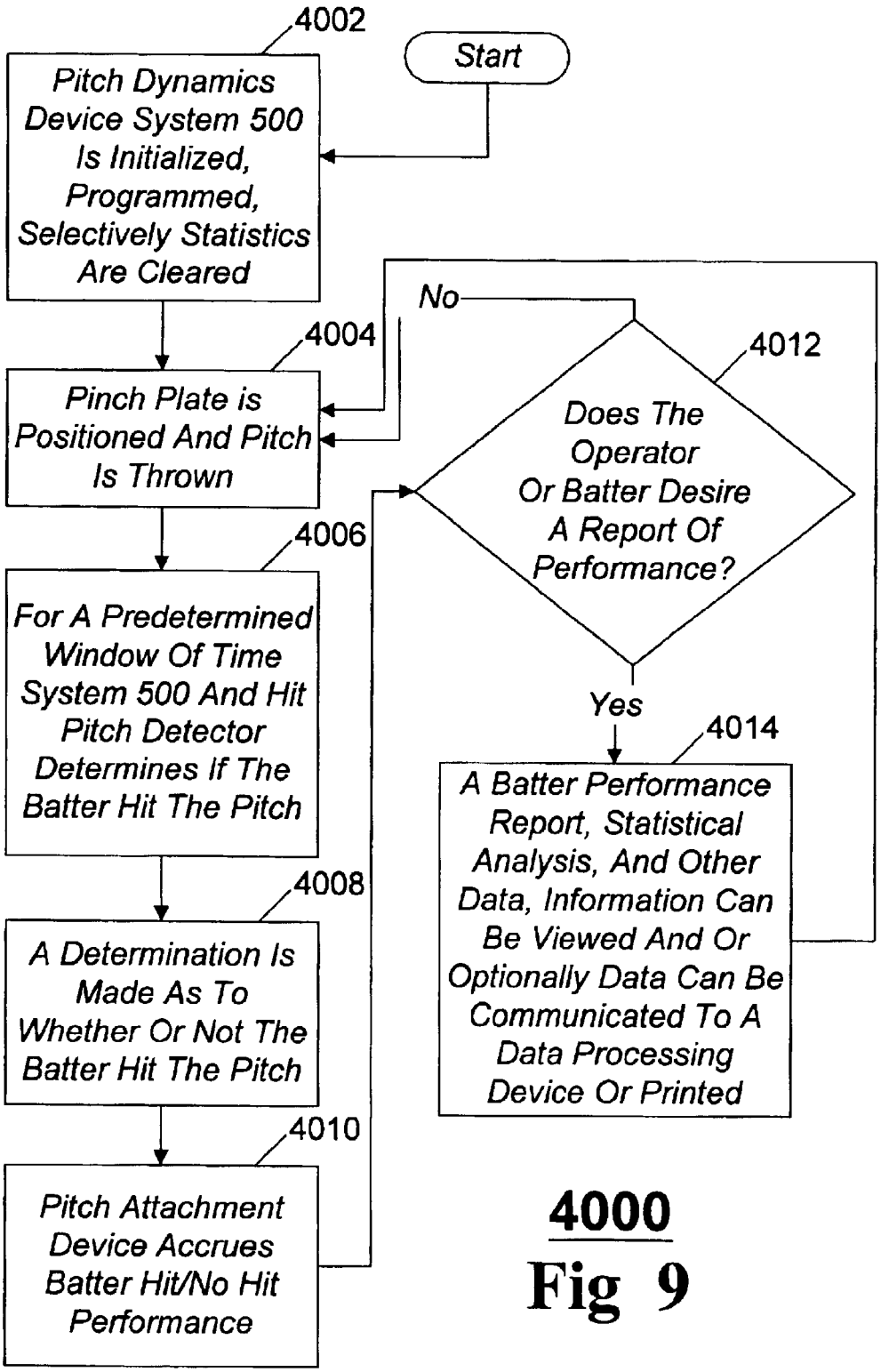
FIG. 9 shows a flowchart 4000 detailing how a hit pitch detector 510 can be used to determine batter performance, types and kinds of pitched balls, and or other statistical results or data.

Referring to FIG. 9 there is shown a flowchart 4000 detailing how a hit pitch detector 510 can be used to determine batter performance, types and kinds of pitched balls, and or other statistical results or data. In an exemplary embodiment, a hit pitch detector 510 can be utilized to determine if the batter hit a pitch. In this regard, statistics related to batter performance can be monitored, stored, calculated, and or otherwise data communicated and or displayed. In addition, the control system 500 having a hit pitch detector 510 can indicate the types and kinds of pitches thrown and types and kinds of pitches hit by the batter. Processing begins in block 4002.

In block 4002 the pitch dynamics device electronic control system 500 is initialized, programmed, and or selectively statistics are cleared. In this regard, the control system 500 is prepared for the running of a pitch routine, for the monitoring of batter performance, and or for the control of the pitch dynamics device. Processing then moves to block 4004.

In block 4004 the pinch plate 106 is positioned in accordance with the pitch routine and control system 500 programming. The pitch is then thrown to the batter. Processing then moves to block 4006.

In block 4006 for a predetermined window of time the hit pitch detector 510 determines if the batter hit the pitch.

In an exemplary embodiment, and with reference to FIG. 4 the control system 500 by way of a hit pitch detector 510 starts monitoring for the pitch to be hit when the pitch is thrown from the pitching machine 100. This can be referred to as the PITCH THROWN START TEST 402. In this regard, a time interval starting from the pitch being thrown representing a start time PITCH THROWN START TEST 402 to a stop time STOP TEST 406, which is a sufficient interval of time after the pitch is thrown to allow the pitch to travel to the batter, be by the batter hit, and detected by the hit pitch detector 510 (such as PITCH HIT 404). If during this time interval the hit pitch detector 510 determines that the batter hit or missed the pitch, appropriate statistics, counters, and other data processing occurs to record the event.

Processing in block of 4006 starts, monitors, and stops the time interval in accordance with control system 500 programming. During this time interval, control system 500 by way of hit detection detector 510 monitors the pitch to determine if they batter hit it. Processing then moves to block 4008.

In block 4008 a determination is made as to whether or not the batter hit the pitch. Processing then moves to block 4010.

In block 4010 the pitch dynamics device by a way of control system 500 accrues the appropriate statistics, data, and other data processing requirements to accrue and account for the batter's hit and no hit performance. In addition, the type of pitch can also be recorded such that the batter's performance can reflect not only how many pitches were thrown but in addition how the batter performed on each type of pitch thrown (fast-speed or off-speed pitches). Processing then moves to decision block 4012.

In decision block 4012 a determination is made as to whether the operator or the batter desires a report of performance. If the resultant is in the affirmative that is the operator or batter desires a report of performance processing the moves to block 4014. If the resultant is in the negative that is the operator or battered does not desire a report of performance then processing moves back to block 4004.

In block 4014 a batter performance report, statistical analysis, and other data, and or information can be viewed and or optionally data communicated to a data processing device and or printed. Processing then moves back to block 4004.

Figure 10:
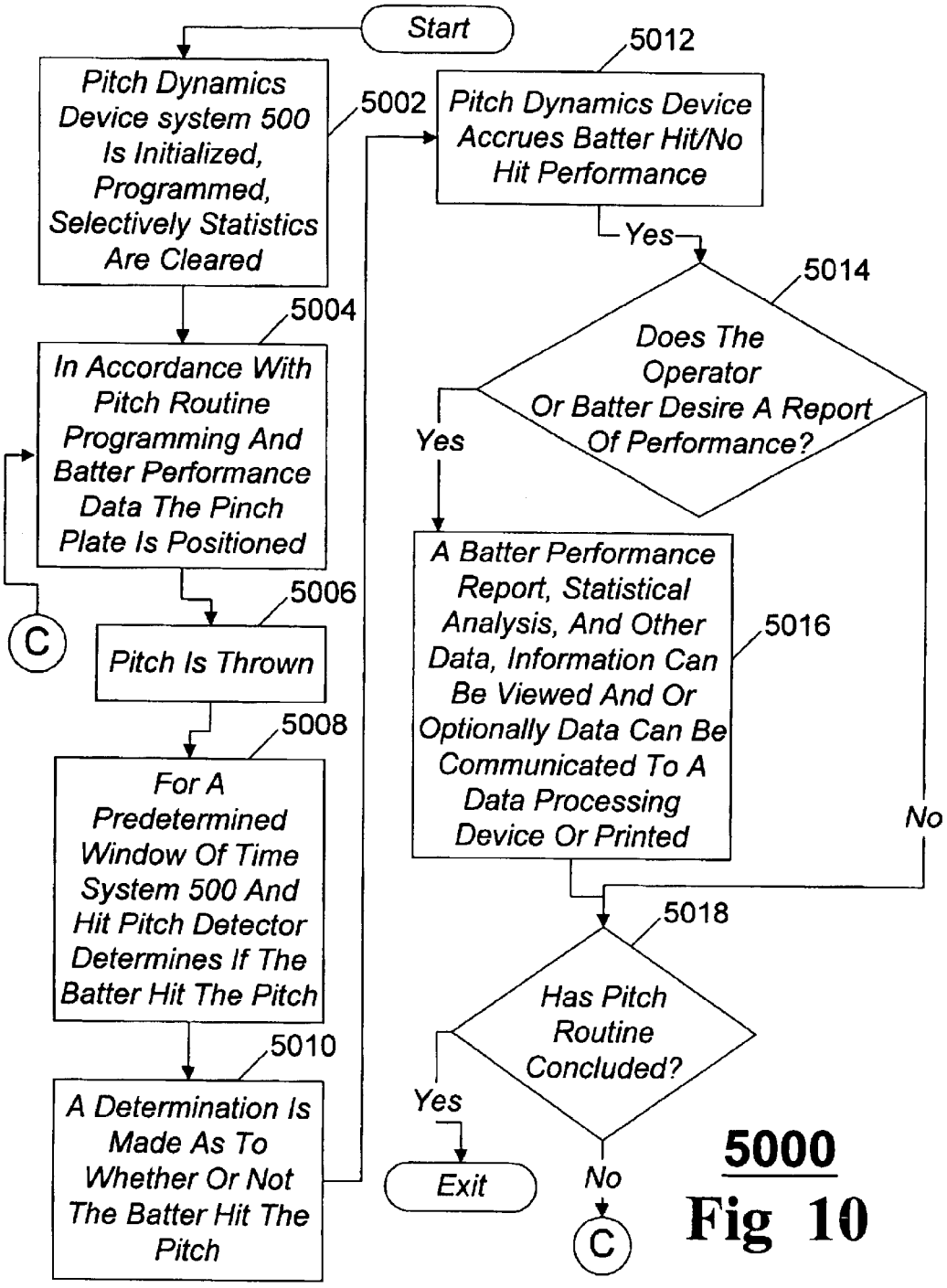
FIG. 10 shows a flowchart 5000 detailing utilizing feedback of a hit pitch detector 510 to determine which types of pitches the batter is hitting/not hitting and utilizing such information to further select the types of pitches to throw.

Referring to FIG. 10 there is shown a flowchart 5000 detailing the utilization of feedback data from a hit pitch detector 510 to determine which types of pitches the batter is hitting and or not hitting and utilizing such information to further select the types of pitches to throw.

In an exemplary embodiment the hit pitch detector 510 can be utilized to determine the batter's performance and subsequently used to make changes to and or determine a pitch routine. In this regard, for example and not limitation, if the batter is having trouble hitting fast-speed pitches the hit pitch detector 510 can detect this and subsequently pitch to the batter additional fast-speed pitches in an attempt to give the batter an opportunity to improve his batting performance of fast-speed pitches. Processing begins in block 5002.

In block 5002 the pitch dynamics device electronic control system 500 is initialized, programmed, and or selectively prepared for operation. In this regard, the pitch dynamics device electronic control system 500 is prepared for executing a pitch routine and for collecting batter performance data by way of a hit pitch detector 510. Processing then moves to block 5004.

In block 5004 in accordance with pitch routine programming and real time batter performance data including data determined and or obtained by way of the utilization of a hit detector 510 over individual pitches and or multiple pitches, the pinch plate 106 is positioned accordingly and the pitch routine modified accordingly. Processing then moves to block 5006.

In block 5006 the pitch is thrown. Processing the moves to block 5008.

In block 5008 for a predetermined window of time (better detailed in FIG. 4) the hit pitch detector 510 determines if the batter hit the pitch. In an exemplary embodiment, and with reference to FIG. 4 the control system 500 by way of a hit pitch detector 510 starts moving for the hit pitch to be hit when the pitch is thrown from the pitching machine 100. In this regard, a time interval starting from the pitch being thrown representing a start time to a stop time which is a sufficient interval of time after the pitch is thrown to allow the pitch to travel to the batter and be hit is monitored. If during this time interval the hit pitch detector 510 determines that the batter hit or missed the pitch appropriate statistics, counters, and other data processing occurs to record the event.

Processing in block 5008 starts, monitors, and stops the time interval in accordance with control system 500 programming. During this time interval, control system 500 by way of hit detection detector 510 monitors the pitch to determine if the batter hit the pitch. Processing then moves to block 5010.

In block 5010 a determination is made as to whether or not the batter hit the pitch. Processing then moves to block 5012.

In block 5012 the pitch dynamics device by way of control system 500 accrues the appropriate statistics, data, and other data processing requirements to accrue and account for the batter's hit and no hit performance. In addition, the type of pitch can also be recorded such that the batter's performance can reflect not only how many pitches were thrown but in addition how the batter performed on each type of pitch thrown (fast-speed and or off-speed pitches). Processing then moves to decision block 5014.

In decision block 5014 a determination is made as to whether the operator or the batter desires a report of performance. If the resultant is in the affirmative that is the operator or batter desires a report of performance processing then moves to block 5016. If the resultant is in the negative that is the operator or batter does not desire a report of performance then processing moves to the decision block 5018.

In block 5016 a batter performance report, statistical analysis, other data, and or information can be viewed and or optionally data communicated to a data processing devices and or printed. Processing then moves to decision block 5018.

In decision block 5018 a determination is made as to whether the pitch routine has concluded. If the resultant is in the affirmative that is the pitch routine has concluded the routine is exited. If the resultant is in the negative that is the pitch routine has not concluded then processing returns to block 5004.

While this invention has been described with reference to specific embodiments, it is not necessarily limited thereto. Accordingly, the appended claims should be construed to encompass not only those forms and embodiments of the invention specifically described above, but to such other forms and embodiments, as may be devised by those skilled in the art without departing from its true spirit and scope.

What is claimed is:

1. A pitch dynamics device comprising:

a pinch plate, said pinch plate is movably attached to a pitching machine; and a positioning actuator operationally connected with said pinch plate, said positioning actuator positions said pinch plate effectuating control of the pitch dynamics of a pitched ball from said pitching machine, without changing said pitching machine pitching wheel speed, by transitioning said pinch plate between:

a mostly horizontal position, at a minimum distance from said pitching machine pitching wheel, effectuating the throwing of said pitched ball with fast-speed pitch dynamics; and an angled position, slowing pitch speed by decreasing the amount of pinch between said pinch plate and said pitching machine pitching wheel, and moving the pitch release point to an elevated trajectory, to maintain said pitched ball accuracy, effectuating the throwing of said pitched ball with off-speed pitch dynamics.

2. The pitch dynamics device in accordance with claim 1, wherein said positioning actuator is at least one of the following:

i) a pinch plate support leg;

ii) a handle;

iii) a handle support;

iv) a pinch plate support;

v) a knob;

vi) a plurality of locking pegs;

vii) a cam; or viii) a solenoid.

3. The pitch dynamics device in accordance with claim 2, wherein said pinch plate supporting leg further having a slot, said slot controlling the range of motion of said pinch plate support leg and the positioning of said pinch plate.

4. The pitch dynamics device in accordance with claim 2, wherein said pitch dynamics device includes at least two of said pinch plate support leg, a first said pinch plate support leg having a slot of length approximately three-quarters of an inch, and a second said pinch plate support leg having a slot of length approximately one-half of an inch, said first said pinch plate support leg and said second said pinch plate support leg control the positioning and angle of said pinch plate.

5. The pitch dynamics device in accordance with claim 1, wherein said pitch dynamics device further comprises a control system interconnect with said pitch dynamics device.

6. The pitch dynamics device in accordance with claim 5, wherein said control system further comprises:

a microcontroller; and a position control interface interconnected with said microcontroller, said position control interface is operationally connected with said positioning actuator, said positioning actuator is operationally connected with said pinch plate, said position control interface effectuates positioning control of said pinch plate by way of said positioning actuator.

7. The pitch dynamics device in accordance with claim 5, wherein said control system includes a hit pitch detector.

8. The pitch dynamics device in accordance with claim 7, wherein said hit pitch detector utilizes at least one of the following methods to detect whether said pitched ball was hit:

i) acoustical detection;

ii) electronic detection; or iii) optical detection.

9. The pitch dynamics device in accordance with claim 5, wherein said control system effectuates a pitch routine.

10. The pitch dynamics device in accordance with claim 5, wherein said control system includes a hit pitch detector, said control system utilizes hit pitch detection, in part, to determine whether the next said pitched ball is thrown with fast-speed or off-speed pitch dynamics.

11. The pitch dynamics device in accordance with claim 5, wherein said control system includes a plurality of data communication interfaces.

12. The pitch dynamics device in accordance with claim 11, wherein said data communication interfaces include at least one of the following:

i) a keypad;

ii) a touch pad;

iii) a display;

iv) an IRDA interface;

v) a plurality of general purpose input and or outputs;

vi) a wired interface;
vii) a wireless interface;
viii) an RS232 interface;
ix) an RS485 interface;
x) a USB interface;
xi) a user interface;
xii) an audio interface;
xiii) a printer interface;
xiv) a serial communication interface;
xv) LAN;
xvi) WAN;
xvii) TCP/IP;
xviii) ETHERNET;
xix) FIREWIRE;
xx) WIRELESS APPLICATION PROTOCOL;
xxi) WI-FI;
xxii) BLUETOOTH;
xxiii) WCDMA;
xxiv) IRDA;
xxv) GSM;
xxvi) PCS;
xxvii) GPRS;
xxviii) 1XRT;
xxix) CDMA;
xxx) CDMA 2000;
xxxi) WCDMA;
xxxii) CDPD;
xxxiii) TDMA;
xxxiv) 2G type compliant;
xxxv) 2.5G type compliant;
xxxvi) 3G type compliant;
xxxvii) 4G type compliant;
xxxviii) spread spectrum;
xxxix) a single frequency transceiver;
xl) a dual frequency transceiver;
xli) IEEE 802.11;
xlii) IEEE 802.11A;
xliii) IEEE 802.11B; or
xliv) IEEE 802.11G.

13. The pitch dynamics device in accordance with claim 5, wherein said pitch dynamics device further comprises a tree light interconnected with said control system.

14. The pitch dynamics device in accordance with claim 13, wherein said tree light indicates at least one of the following conditions;

i) said pitching machine is preparing to throw said pitched ball;
ii) said pitching machine has thrown said pitched ball; or
iii) a batter should swing at said pitched ball.

15. The pitch dynamics device in accordance with claim 1, wherein said pitch dynamics device further comprises a brush attachment interconnect with said pitch dynamics device or said pitching machine.

16. A method of utilizing a pitch dynamics device to change pitch dynamics of pitching machine pitched balls, said method comprising:

a) loosening a pinch plate, said pinch plate being movably attached to a pitching machine;
b) aligning selectively said pinch plate, by way of a positioning actuator, said positioning actuator being operationally connected with said pinch plate, said pinch plate effectuates control of the pitch dynamics of a pitched ball from said pitching machine, without changing said pitching machine pitching wheel speed, by transitioning said pinch plate between:
i) a mostly horizontal position, at a minimum distance from said pitching machine pitching wheel, causing said pitching machine to throw said pitched ball with fast-speed pitch dynamics; and
ii) an angled position, slowing pitch speed by decreasing the amount of pinch between said pinch plate and said pitching machine pitching wheel and moving the pitch release point to an elevated trajectory, to maintain said pitched ball accuracy, causing said pitching machine to throw said pitched ball with off-speed pitch dynamics;
c) securing said pinch plate in preparation of throwing said pitched ball.

17. A method of utilizing a pitch dynamics device effectuated pitching routine to control the pitch dynamics of pitched balls, said method comprising:

a) positioning initially by way of a control system a pinch plate, said pinch plate controls the pitch dynamics of a pitch to be thrown, from a pitching machine, to a batter, said control system being interconnected with said pitch dynamics device;
b) throwing said pitch from said pitching machine;
c) selecting the pitch dynamics of the next said pitch based in part on a pitch routine executed by said control system, or selectively based in part on operator input;
d) repositioning by way of said control system said pinch plate, effectuating control of the pitch dynamics of the next said pitch to be thrown, from said pitching machine, to said batter; and
e) returning selectively to step 'b'.

18. The method in accordance with claim 17, wherein selecting the pitch dynamics step 'c' includes selecting the pitch dynamics based in part on at least one of the following:

i) data communication with a wireless device;
ii) data communication with a wired device;
iii) a preprogrammed pitch routine;
iv) by psuedo random pitch selection;
v) by random pitch selection; or
vi) by utilization of a hit pitch detector.

19. A method of utilizing a pitch dynamics device having hit pitch detection to control the pitch dynamics of pitched balls, said method comprising:

a) positioning initially, by way of a control system a pinch plate, said pinch plate controls the pitch dynamics of a pitch to be thrown from a pitching machine to a batter, said control system being interconnected with said pitch dynamics device;
b) throwing said pitch from said pitching machine;
c) determining if said batter hit said pitch, by way of a hit pitch detector, said hit pitch detector is interconnected with said control system;
d) determining, by way of said control system, said batter performance based in part on the determination made in step 'c';
e) selecting the pitch dynamics, of the next said pitch, based in part on said batter performance determined in step 'd';
f) repositioning, by way of said control system, said pinch plate effectuating control of the pitch dynamics of the next said pitch to be thrown from said pitching machine to said batter; and
g) returning selectively to step 'b'.

* * * * *